US009493984B2

(12) United States Patent
Casey et al.

(10) Patent No.: US 9,493,984 B2
(45) **Date of Patent: *Nov. 15, 2016**

(54) SYSTEMS AND METHODS TO RETAIN AND REFEED DOOR CURTAINS

(71) Applicant: RITE-HITE HOLDING CORPORATION, Milwaukee, WI (US)

(72) Inventors: Nicholas J. Casey, Cascade, IA (US); Perry W. Knutson, Lancaster, WI (US);
(Continued)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/458,769

(22) Filed: Aug. 13, 2014

(65) Prior Publication Data

US 2014/0345812 A1 Nov. 27, 2014

Related U.S. Application Data

(63) Continuation-in-part of application No. 13/922,987, filed on Jun. 20, 2013, now Pat. No. 9,222,304.
(Continued)

(51) Int. Cl.
*E06B 9/56* (2006.01)
*E06B 9/58* (2006.01)
(Continued)

(52) U.S. Cl.
CPC ..... *E06B 9/581* (2013.01); *E06B 9/13* (2013.01); *E06B 2009/585* (2013.01);
(Continued)

(58) Field of Classification Search
CPC ..... E06B 9/11; E06B 9/13; E06B 9/17; E06B 9/58; E06B 9/581; E06B
(Continued)

(56) References Cited

U.S. PATENT DOCUMENTS 1,677,230 A 7/1928 De Mercurio
1,694,314 A 12/1928 Dixson
(Continued)

FOREIGN PATENT DOCUMENTS

DE 10202866 A1 8/2003
EP 0688936 12/1995
(Continued)

OTHER PUBLICATIONS

International Searching Authority, Search Report, issued in connection with International patent application No. PCT/US2014/031449, mailed on Nov. 11, 2014, 8 pages.
(Continued)

*Primary Examiner* — Katherine Mitchell
*Assistant Examiner* — Johnnie A Shablack
(74) *Attorney, Agent, or Firm* — Hanley, Flight & Zimmerman, LLC

(57) ABSTRACT

An example door includes a track and a curtain that includes a leading section. The curtain is to be in a breakaway state associated with a folded condition when the lateral section in an area proximate the leading section is dislodged from the track and folded over onto a main section to define an enfolded space. The curtain is to be in the breakaway state associated with an unfolded condition when the lateral section in the area proximate the leading section is dislodged from the track but not folded over onto the main section. The example door also includes an unfolder to extend into the enfolded space as the leading section moves toward an open position while the curtain is in the folded condition.

21 Claims, 24 Drawing Sheets

(72) Inventors: Ryan P. Beggs, Dubuque, IA (US); Timothy A. Haessler, Dubuque, IA (US); William W. Hoerner, Dubuque, IA (US)

Related U.S. Application Data

(60) Provisional application No. 61/811,407, filed on Apr. 12, 2013.

(51) Int. Cl.
*E06B 9/13* (2006.01)
*E06B 9/68* (2006.01)

(52) U.S. Cl.
CPC *E06B 2009/6818* (2013.01); *E06B 2009/6827* (2013.01); *E06B 2009/6836* (2013.01); *E06B 2009/6845* (2013.01)

(58) Field of Classification Search
CPC ..... 2009/6818;E06B 2009/585; E06B 2009/6836; E06B 2009/6845
USPC ..... 160/273.1
See application file for complete search history.

(56) References Cited

U.S. PATENT DOCUMENTS

| | | | | |
|---|---|---|---|---|
| 1,764,880 | A | 6/1930 | Nelson | |
| 1,779,646 | A * | 10/1930 | Traut | 160/271 |
| 2,349,226 | A | 5/1944 | Thomas | |
| 4,478,268 | A * | 10/1984 | Palmer | 160/310 |
| 4,884,617 | A | 12/1989 | Coenraets | |
| 4,987,943 | A | 1/1991 | Charest | |
| 5,291,932 | A | 3/1994 | Kraeutler | |
| 5,351,742 | A | 10/1994 | Lichy | |
| 5,377,738 | A | 1/1995 | Cooper | |
| 5,445,209 | A * | 8/1995 | Lichy | 160/273.1 |
| 5,482,104 | A | 1/1996 | Lichy | |
| 5,526,865 | A | 6/1996 | Coenraets | |
| 5,632,317 | A | 5/1997 | Krupke et al. | |
| 6,068,040 | A | 5/2000 | Magro et al. | |
| 6,119,758 | A | 9/2000 | Coenraets | |
| 6,598,648 | B1 | 7/2003 | Schulte | |
| 6,722,416 | B2 | 4/2004 | Varley et al. | |
| 7,028,741 | B2 | 4/2006 | Coenraets | |
| 7,036,549 | B2 | 5/2006 | Coenraets | |
| 7,131,481 | B2 | 11/2006 | Varley et al. | |
| 7,389,807 | B2 | 6/2008 | Nagare et al. | |
| 7,416,014 | B2 | 8/2008 | Coenraets | |
| 7,665,506 | B2 * | 2/2010 | Coenraets | 160/266 |
| 7,748,431 | B2 * | 7/2010 | Jansen et al. | 160/268.1 |
| 7,762,304 | B2 * | 7/2010 | La Marca et al. | 160/8 |
| 7,814,958 | B2 * | 10/2010 | Hansen et al. | 160/370.22 |
| 7,841,377 | B2 * | 11/2010 | Coenraets | 160/268.1 |
| 8,037,921 | B2 | 10/2011 | Dondlinger et al. | |
| 8,109,317 | B2 * | 2/2012 | Bostyn | 160/273.1 |
| 8,113,265 | B2 * | 2/2012 | Hardison et al. | 160/273.1 |
| 8,272,425 | B2 * | 9/2012 | Coenraets | 160/273.1 |
| 8,678,070 | B2 * | 3/2014 | Kimener | 160/271 |
| 8,851,147 | B2 | 10/2014 | Drifka et al. | |
| 8,887,790 | B2 | 11/2014 | Drifka | |
| 8,997,831 | B2 * | 4/2015 | Lin | 160/370.22 |
| 2004/0020611 | A1 | 2/2004 | Coenraets | |
| 2005/0067118 | A1 | 3/2005 | Coenrates | |
| 2005/0178510 | A1 * | 8/2005 | Coenraets | 160/271 |
| 2005/0211397 | A1 | 9/2005 | Coenraets | |
| 2005/0211398 | A1 | 9/2005 | Coenraets | |
| 2006/0248819 | A1 | 11/2006 | Coenraets | |
| 2007/0277924 | A1 | 12/2007 | Groppe | |
| 2007/0277941 | A1 | 12/2007 | Jansen et al. | |
| 2007/0277942 | A1 | 12/2007 | Dondlinger et al. | |
| 2007/0277943 | A1 | 12/2007 | Boerger et al. | |
| 2008/0035282 | A1 | 2/2008 | Coenraets | |
| 2008/0229665 | A1 | 9/2008 | Kimener | |
| 2009/0178769 | A1 | 7/2009 | Miller | |
| 2010/0132894 | A1 * | 6/2010 | Knutson et al. | 160/113 |
| 2010/0181033 | A1 | 7/2010 | Bostyn | |
| 2010/0236725 | A1 | 9/2010 | Kraeutler | |
| 2011/0005138 | A1 * | 1/2011 | Drifka et al. | 49/360 |
| 2011/0108214 | A1 | 5/2011 | Komatsu et al. | |
| 2013/0061525 | A1 | 3/2013 | Drifka | |
| 2013/0098566 | A1 | 4/2013 | Horvath | |
| 2014/0020853 | A1 * | 1/2014 | Balay et al. | 160/273.1 |
| 2014/0158313 | A1 | 6/2014 | McTavish et al. | |
| 2014/0305600 | A1 | 10/2014 | Casey et al. | |
| 2014/0345812 | A1 * | 11/2014 | Casey et al. | 160/273.1 |
| 2015/0096696 | A1 * | 4/2015 | Sentjurc | 160/309 |

FOREIGN PATENT DOCUMENTS

| | | | |
|---|---|---|---|
| EP | 0775797 | A1 | 5/1997 |
| EP | 1655447 | A1 | 5/2006 |
| EP | 2441911 | A1 | 4/2012 |
| FR | 1405971 | | 6/1965 |
| GB | 1545508 | | 5/1979 |
| JP | 2001182456 | | 7/2001 |
| JP | 2001182456 | A | 7/2001 |
| WO | 03048497 | | 6/2003 |
| WO | 2006120655 | | 11/2006 |
| WO | 2008155292 | | 12/2008 |

OTHER PUBLICATIONS

International Searching Authority, Written Opinion, issued in connection with International patent application No. PCT/US2014/031449, mailed on Nov. 11, 2014, 18 pages.

United States Patent and Trademark Office, Non-Final Office action, issued in connection with U.S. Appl. No. 13/922,987, mailed on Feb. 27, 2015, 66 pages.

International Searching Authority, Invitation to Pay Additional Fees and, where applicable, protest fee, issued in connection with PCT application No. PCT/US2014/031449, mailed on Jul. 29, 2014, 11 pages.

The United States Patent and Trademark Office, Restriction Requirement, issued in connection with U.S. Appl. No. 13/922,987, mailed on Dec. 26, 2014, 9 pages.

International Bureau, International Preliminary Report on Patentability, issued in connection with PCT patent application No. PCT/US14/31449, Oct. 13, 2015, 19 pages.

International Searching Authority, Search Report, issued in connection with PCT patent application No. PCT/US2015/044835, mailed on Oct. 21, 2015, 5 pages.

International Searching Authority, Written Opinion, issued in connection with PCT patent application No. PCT/US2015/044835, mailed on Oct. 21, 2015, 7 pages.

European Patent Office, Communication pursuant to Rules 161(1) and 162 EPC, issued in connection with European patent office No. 14717643.2, Nov. 27, 2015, 2 pages.

United States Patent and Trademark Office, Final office action, issued in connection with U.S. Appl. No. 13/922,987, mailed on Jun. 12, 2015. 26 pages.

United States Patent and Trademark Office, Notice of Allowance, issued in connection with U.S. Appl. No. 13/922,987, mailed on Aug. 20, 2015, 31 pages.

Australian Patent Office, Examination Report No. 1, issued in connection with Australian Patent application No. 2014251271, May 6, 2016, 3 pages.

Chinese Patent Office, First Office Action, issued in connection with Chinese Patent Application No. 2014800209532, Apr. 1, 2016, 17 pages.

* cited by examiner

FIG. 17

1700

122

| | | SECOND SENSOR SIGNAL | |
|---|---|---|---|
| | | TRUE | FALSE |
| FIRST SENSOR SIGNAL | TRUE | NON-RESTORABLE | NON-RESTORABLE |
| | FALSE | RESTORABLE | NORMAL |

66

SYSTEMS AND METHODS TO RETAIN AND REFEED DOOR CURTAINS

RELATED APPLICATION

This patent claims priority to U.S. Provisional Application Ser. No. 13/922,987, filed on Jun. 20, 2013, which is a non-provisional application of U.S. Provisional Application Ser. No. 61/811,407, filed on Apr. 12, 2013, both of which are hereby incorporated herein by reference in their entireties.

FIELD OF THE DISCLOSURE

This patent generally pertains to door curtains and more specifically to systems and methods to retain and refeed door curtains.

BACKGROUND

Some industrial doors have a movable curtain for separating areas within a building or closing off doorways that lead outside. Examples of such doors include planar doors, overhead-storing doors and roll-up doors. Planar doors have curtains that remain generally planar as the curtain, guided by tracks, translates between open and closed positions. Some planar doors have wheels, trolleys or sliding members that couple the curtain to the tracks.

Overhead-storing doors are similar to many conventional garage doors in that overhead-storing doors have guide tracks that curve between a vertical section across the doorway and a horizontal section above the doorway. To open and close the door, the curtain travels to the horizontal and vertical sections, respectively.

A roll-up door comprises a roll-up curtain that when the door is open the curtain is wound about a roller or otherwise coiled above the doorway. To close the door, the curtain unwinds as two vertical tracks guide the curtain across the doorway. Roll-up doors are typically either powered open and closed or are powered open and allowed to fall closed by gravity.

Some roll-up doors have a rigid leading edge provided by a rigid or semi-rigid bar extending horizontally along a lower portion of the curtain. The rigidity of the bar helps keep the curtain within the guide tracks and helps the curtain resist wind and other air pressure differentials that may develop across opposite sides of the door.

Other roll-up doors have a curtain with a relatively soft leading edge. To help keep such a curtain within its guide tracks, as well as keep the curtain taut and square to the doorway, opposite ends of the bottom portion of the curtain can be held in tension by two opposing carriages, trolleys or sliding guide members that are constrained to travel along the tracks. The door's lower leading edge, however, does not necessarily have to be held in tension, especially when the door is not subject to significant pressure differentials.

Industrial doors are often used in warehouses, where the doors are susceptible to being struck by forklifts or other material handling equipment. A collision can also occur when a door accidentally closes upon an obstacle in its path, such as an object or a person. To protect the door and the vehicle from damage and to protect personnel in the area, often some type of breakaway or compliant feature is added to the door. For a door having a rigid reinforcing bar along its leading edge, the bar may be provided with sufficient flexibility and resilience to restorably disengage its tracks during a collision. Doors having a relatively soft leading edge may have sufficient flexibility to absorb an impact. Additionally or alternatively, such doors may have a bottom portion that can be coupled to two opposing guide carriages by way of a breakaway coupling. The coupling releases the curtain from the carriage in response to experiencing a breakaway force, thereby limiting the impact force to a safe level.

BRIEF DESCRIPTION OF THE DRAWINGS

FIG. 17 is a truth table showing example states of the example curtain shown in FIGS. 1-16 determined based on feedback signals from sensors.

DETAILED DESCRIPTION

Example door curtains with a restorable breakaway condition is disclosed herein that includes first means for guiding the curtain's lateral edges during normal operation and second independent means for guiding the curtain edges during a separate refeed operation. In some examples, the first means includes a track that guides a vertical row of buttons that are on the curtain. The second means, in some examples, includes a roller near the upper end of the track and an elongate bead on the curtain's lateral edge. In some examples, under normal operation, the buttons slide along the track while the bead travels past the roller with virtually no contact between the bead and the roller. In some examples, during a breakaway, the buttons "pop" out from within the track. Following the breakaway, in some examples, the curtain rises and descends while the roller engages the bead to guide the curtain first up onto a rollup drum and then back down to reinstall the buttons within the track. Additionally, example rollup doors and door methods disclosed herein include means for straightening a dislodged and folded-over door curtain to assist in automatically refeeding the curtain back into its guide tracks. In some examples, the means for straightening the curtain includes an unfolder in the form of a roller. Following a curtain breakaway incident where a portion of the curtain not only pulls out from within its guide tracks but also folds over on itself, a power drive unit raises the dislodged curtain up toward its open position. As the curtain rises, the folded-over section is drawn up against the roller. The roller engages the folded-over section and unfolds it so that the now straightened curtain can be readily fed back into its guide track.

Figure 1:
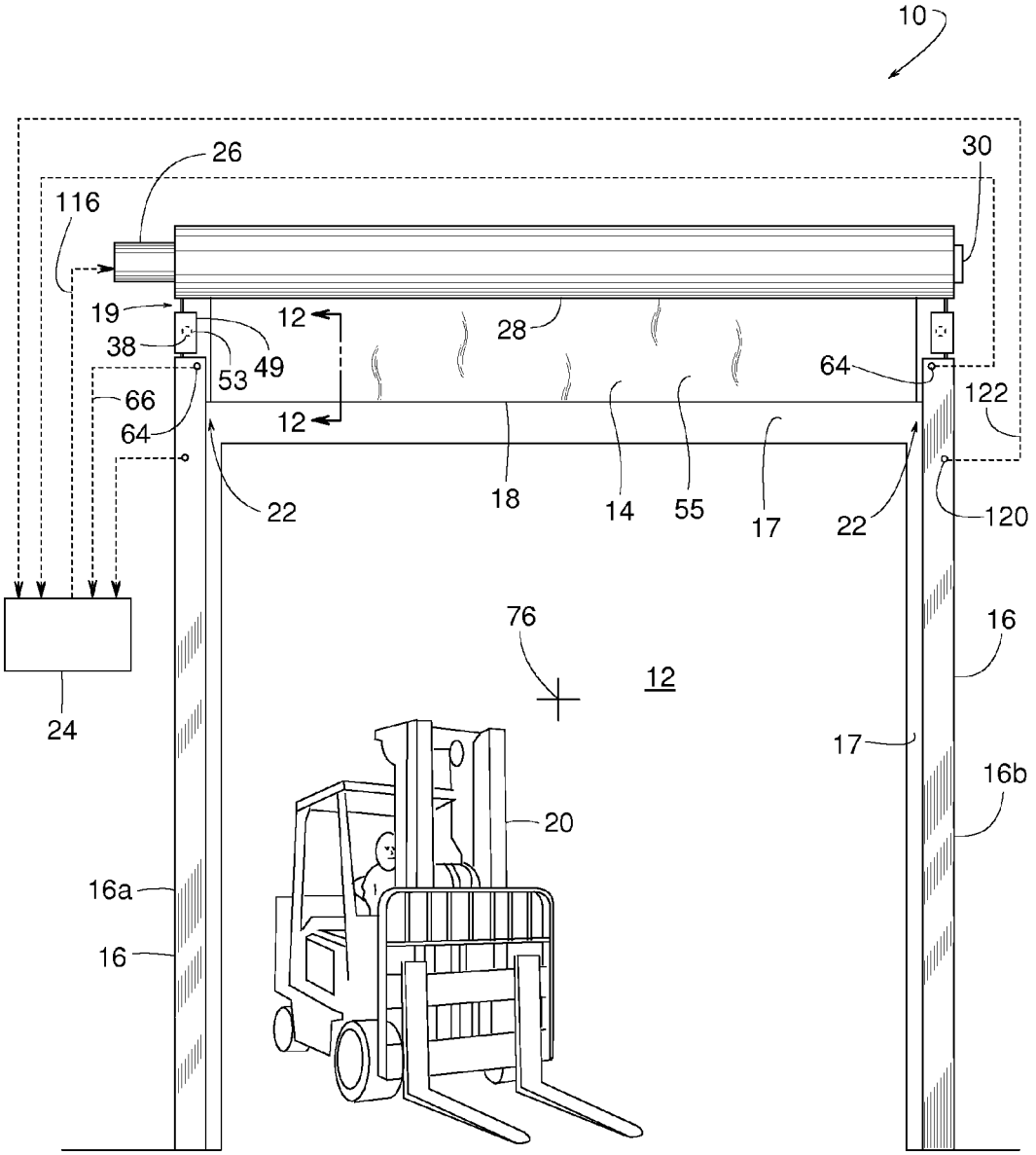
FIG. 1 is a front view of an example door constructed in accordance with the teachings disclosed herein.
Figure 2:
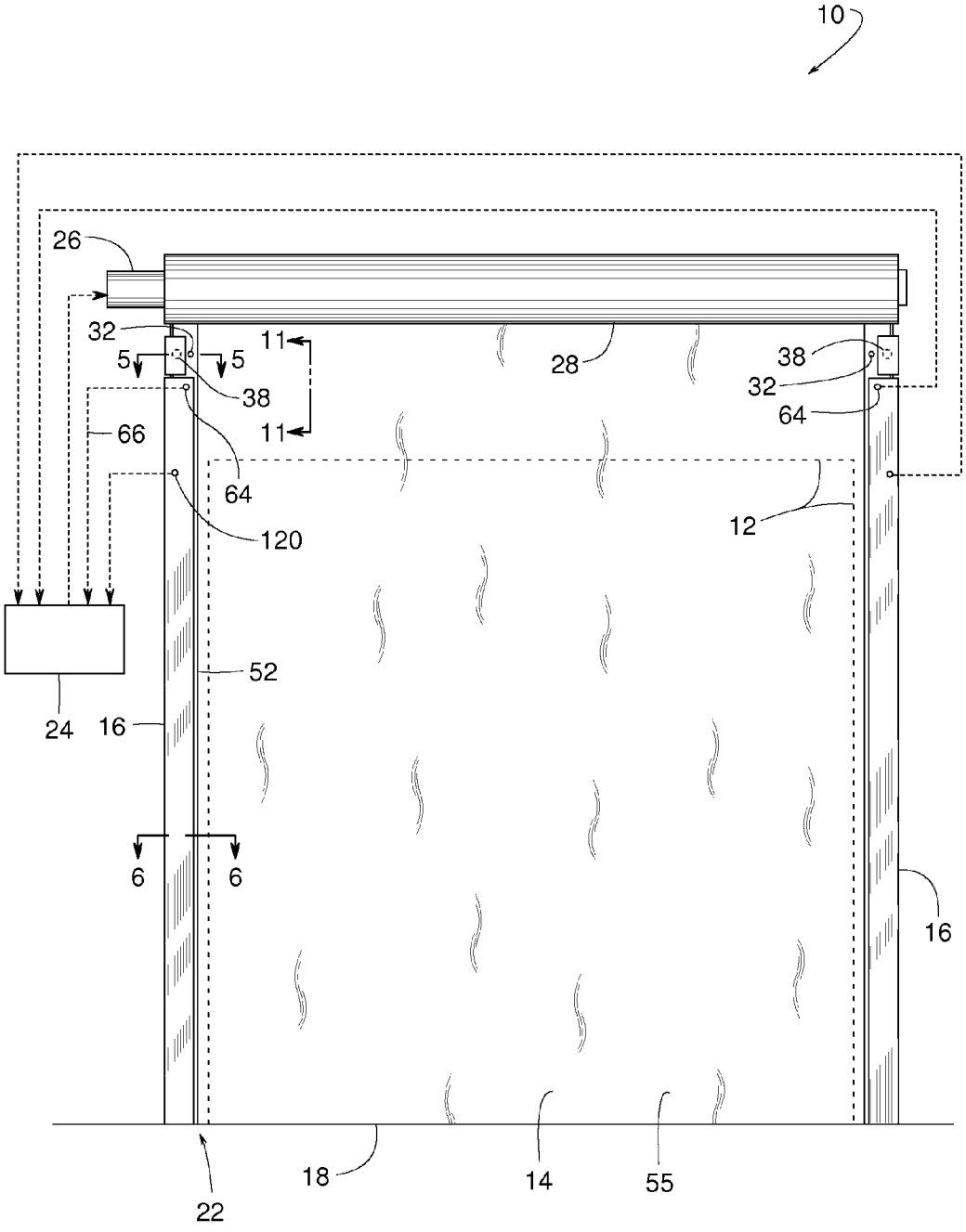
FIG. 2 is a front view similar to FIG. 1 but showing the example door in a closed position.
Figure 12:
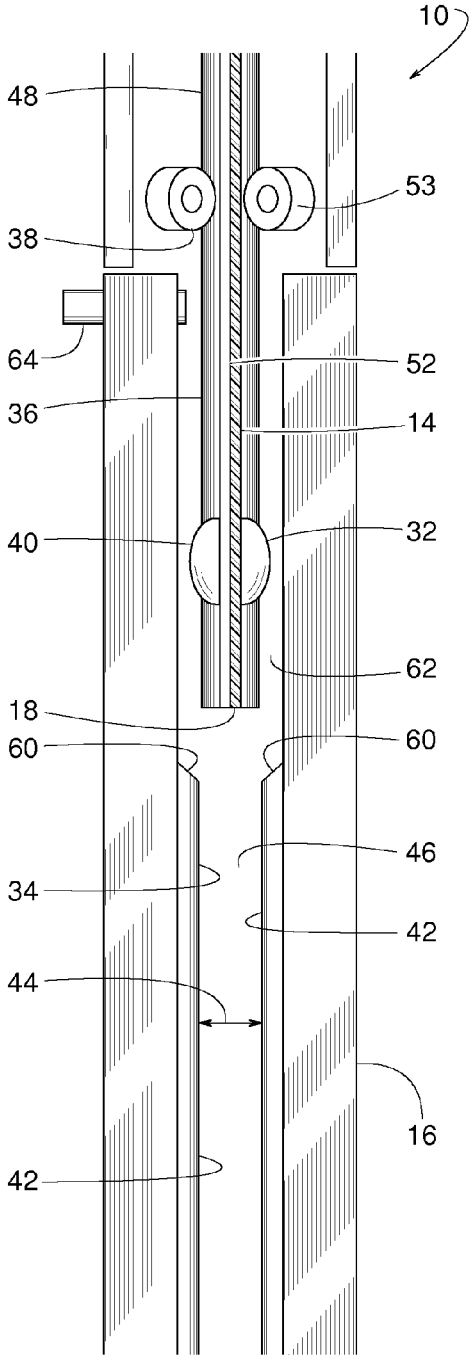
FIG. 12 is a cross-sectional view of the example door of FIG. 1 taken along line 12-12 of FIG. 1.
Figure 13:
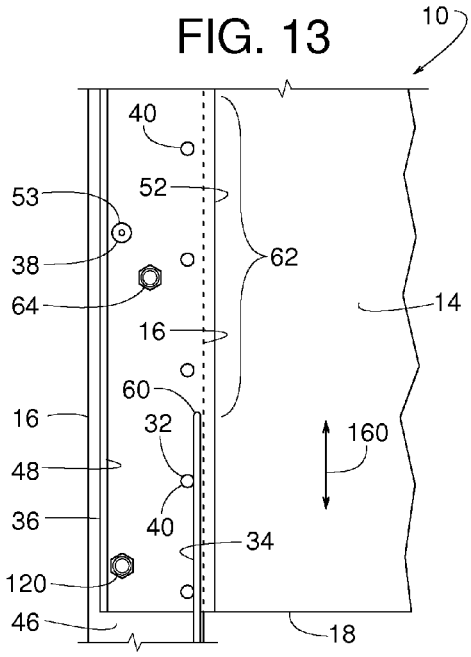
FIG. 13 is a front schematic view of a portion of the example door of FIG. 1 nearly fully open with the curtain in a normal state.
Figure 15:
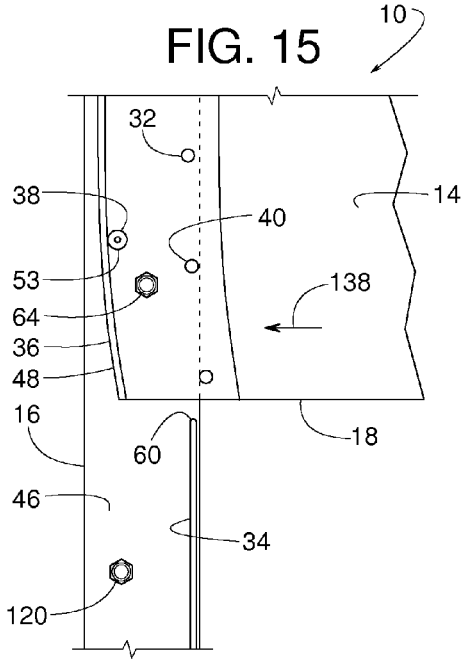
FIG. 15 is a front schematic view of a portion of the example curtain of FIG. 1 returning to normal through a refeed opening in the track.
Figure 16:
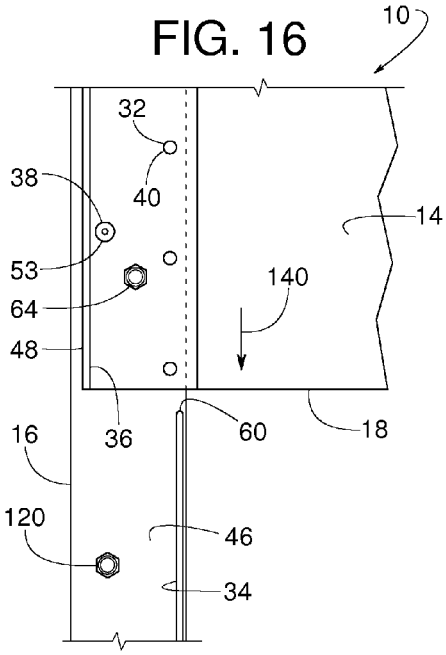
FIG. 16 is a front schematic view of a portion of the example curtain of FIG. 1 about to descend into proper position within the track.

In particular, FIGS. 1-20 show an example door 10 and example methods for selectively blocking and unblocking a doorway 12 in a wall 17. Under normal door operation, a curtain 14 travels along a track 16 (e.g., a first track 16*a* and a second track 16*b*) to open or close the door 10, wherein FIGS. 1, 12 and 16 show a leading edge 18 of the curtain 14 at an open position corresponding to when the door 10 is fully open to unblock the doorway 12, and FIG. 2 shows the curtain's leading edge 18 at a closed position corresponding to when the door 10 is fully closed to block the doorway 12. FIGS. 1, 2 and 13 illustrate examples of curtain 14 being in a normal state.

A beneficial feature of some examples of the door 10 include the separation or independent function of the means for guiding and retaining a lateral edge 19 of the curtain 14 along the track 16 during normal operation and the means for guiding the edge 19 during a separate refeed operation (if the lateral edge 19 breaks away from the track 16). This separation of curtain-guiding means during normal and refeed operations allows each of the two guiding means to be dedicated solely for one purpose, and without compromise.

For lateral curtain retention and curtain travel guidance under normal operation, some examples of the door 10 include a row of raised retention buttons or projections 40 that are widely spaced-apart and attached generally along the curtain's lateral edges 19. The buttons 40, in some examples, protrude outward from each face of curtain 14 and have a generally spherically shaped surface. In some examples, the row of retention buttons 40 are spaced inward from an edge bead 48 and travel within a channel 46 of the guide track 16. At the two inside surfaces of track 16 adjacent each face of the curtain 14, retentions strips or a primary retainer 34 keep the buttons 40 contained within the channel 46 under normal operating conditions to keep the curtain taut in the lateral direction. In some examples, the primary retainer 34 is made of a low friction material, such as ultra high molecular weight polyethylene (UHMW). If wind pressure or an obstacle provides enough force on the curtain 14, the buttons 40 will escape from within the channel 46 (e.g., be force out of the track 16) to prevent damage to the door 10. In some examples, at least one of the two legs or walls of the track 16 (e.g., the opposing walls facing the opposing faces of the curtain 14) is designed to flex outwardly (e.g., away from the curtain 14 by deflection 118), to allow the buttons 40 to escape out from within the channel 46.

In some examples, the edge bead 48 serves to pull the curtain's lateral edge 19 outwardly if the curtain's retention buttons 40 have been displaced out from within the track 16. In some examples, the edge bead 48 extends substantially the full length of the curtain 14. In some example, the edge bead 48 has a continuous cross-sectional profile which is thicker than the curtain 14. Examples of the bead's continuous cross-sectional profile include a round, oval, rectangular or other cross-sectional shapes. Following a breakaway (e.g., the buttons 40 being displaced out from within the track 16), in some examples, a set of guide rollers 53 located above the track 16 will pull the curtain's lateral edge 19 (by contacting and rolling against edge bead 48) back to its normal position as the curtain 14 is rolled up. During the next door closing cycle, the curtain 14 is unrolled and the buttons 40 are properly aligned to re-enter the channel 46 of the track 16.

In some examples, during normal operation of the door 10 (when the buttons 40 are positioned within the channel 46), the edge bead 48 is located outside or beyond (with respect to a central region 76 of the doorway 12) the guide roller's outer surface (diameter 50) and does not ride on the roller 53. Accordingly, in some such examples, during normal operation, the edge bead 48 travels past the rollers 53 and does not guide the edge 19 of the curtain 14 nor does it provide any retention functionality. This reduces wear and reduces (e.g., eliminates) the need for lubrication on the bead 48. Also, in some examples, if an outside force caused the retention buttons 40 to pull out from within the channel 46, the guide rollers 53 do not force the curtain's edge bead 48 back into the channel 46 through the retainer 34. Rather, the guide rollers 53 interact with the bead 48 to reposition the lateral edge 19 of the curtain 14 when rolled up onto the curtain-supporting structure 30 so that the buttons 40 are properly aligned to be lowered behind the retainer 34 (e.g., within the channel 46 of the track 16) during the next door closing cycle. The guide track's channel 46, in some examples, is designed to provide sufficient space such that the edge bead 48 rarely, if ever, has significant contact with the track 16.

In some examples, another important feature of the door 10 is the ability to detect an abnormal door operation and take actions necessary to protect the door from damage. In some examples, when the door's retention buttons 40 pull away from the track 16, a sensor 120 (second sensor) will detect the occurrence, and a controller 24 will automatically decrease the speed of the curtain's drive unit 26. For example, by decreasing the speed at which the curtain 14 is being rolled up, the likelihood of pulling the curtain's edges 19 outward (e.g., via the guide roller 53 engaging the bead 48) and into a normal position is increased, and the chance of curtain damage is reduced. The sensor 120, in some examples, is located about 24 inches below the roller 53.

In some examples, if the edge bead 48 is pulled through (e.g., breaks away from) the guide roller 53 towards the center of the curtain 14, another sensor 64 (first sensor) will detect the occurrence and the controller 24 will automatically stop the drive unit 26 to prevent damaging the curtain 14. The sensor 64, in some examples is located near the guide roller 53. Example locations of the sensor 64 include, but are not limited to, just above the roller 53, just below the roller 53 and at the same elevation as the roller 53. In some examples, if breakaway of the bead 48 from the guide roller 53 occurs and the drive unit 26 is stopped, the controller 24 emits a maintenance alert signal.

Some examples of the door 10 include one or more of the following benefits. In some examples, the curtain 14 includes two different elements for normal guiding and retention (e.g., the buttons 40) and for the refeed process (e.g., the bead 48). In some examples, the two different and separate elements allow the bead 48 to play a passive role with little or no contact with the primary retainer 34 or the roller 53, thereby resulting in reduction or elimination of lubrication, reduction in friction, and significant reduction in wear. In some examples, the design allows a reduced number of retention buttons 40 to be used because of the refeeding operation accomplished by the bead 48 and the roller 53. For example, in some known doors that use buttons or other projections to reefed a door, the buttons are typically spaced close together (e.g., around a maximum of 2 inches apart) and may even be touching. In contrast, in accordance with the teachings disclosed herein, where the refeeding is implemented with the separate edge bead 48, the buttons 40, in some examples, are spaced much farther apart (e.g., 4 inches, 12 inches, 2 feet, etc.). Put another way, in some examples disclosed herein, such as where the buttons 40 are approximately 0.5 inches wide, the distance between buttons 40 can be more than four times the width of the buttons (e.g., more than 2-inches apart) and at least as great as 48 times the width of the buttons 40 (e.g., 2 feet apart). As a result of the greater space between the buttons 40, in some examples, there is less thickness build-up and less wrinkling of the curtain 14 when rolled upon a rollup drum. Additionally, a reduced number of retaining buttons also reduces the friction between the buttons 40 and the retainer 34 when operating the door 10. In some examples, rivets 54 (or similar retention projection fasteners) are designed as shear pins to break before causing a tear or other damage to the relatively expensive curtain. In some examples, the retention buttons 40 are replaceably attached to the door 10 to enable the replacement of the buttons 40 after the door 10 is originally installed. In some examples, curtain speed is automatically reduced when the retention buttons 40 break away from the guide track 16. In some examples, the drive unit 26 is stopped automatically when the edge bead 48 escapes from the guide roller 53 to reduce the likelihood of damaging the curtain 14. In some examples, the guide roller 53 pulls the edge bead 48 outwardly during roll-up to position the retention buttons 40 for proper entry into the track's channel 46 when the next door closing cycle begins.

Figure 3:
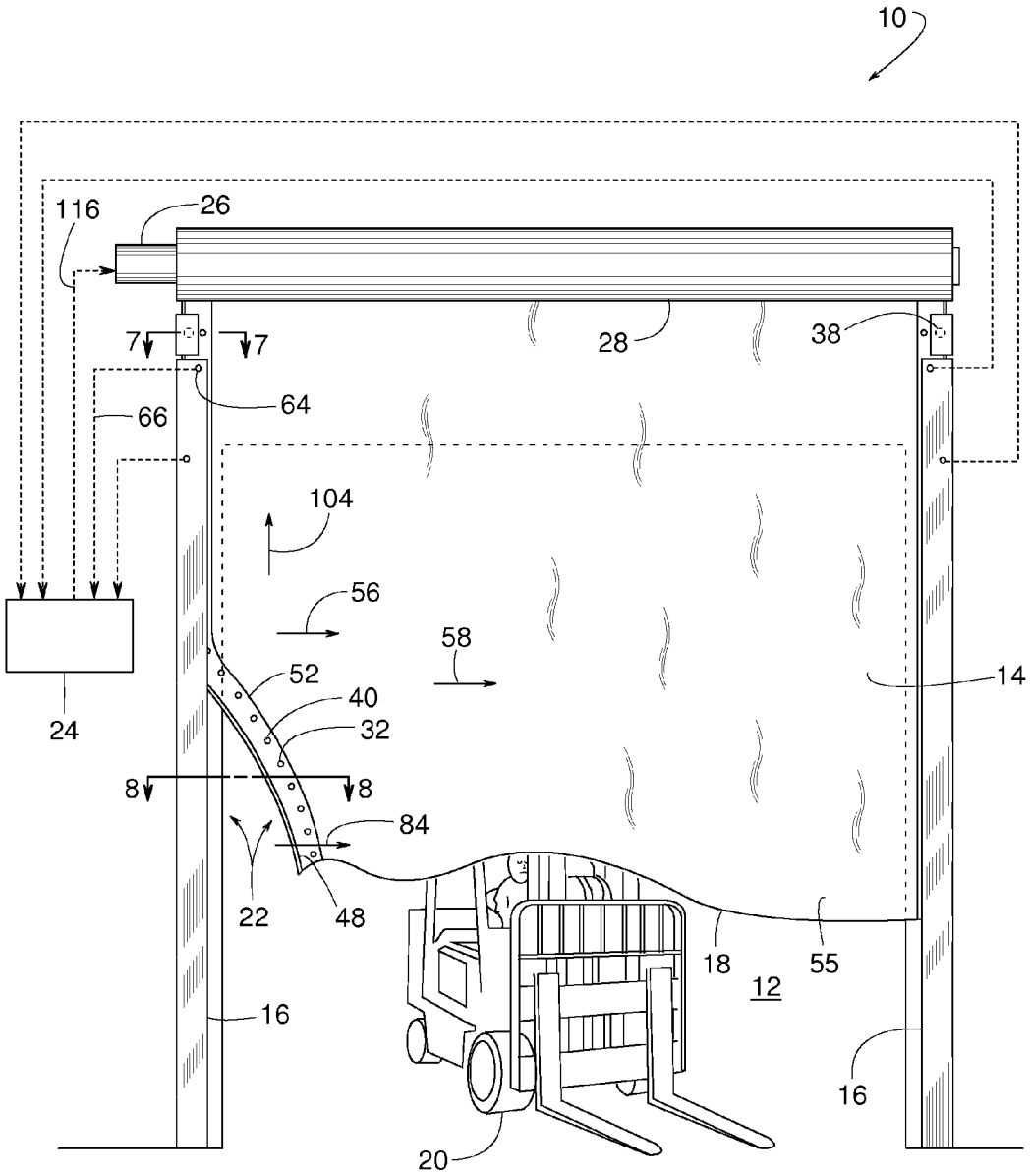
FIG. 3 is a front view similar to FIGS. 1 and 2 but showing the curtain of the example door in a breakaway state in a restorable condition.
Figure 4:
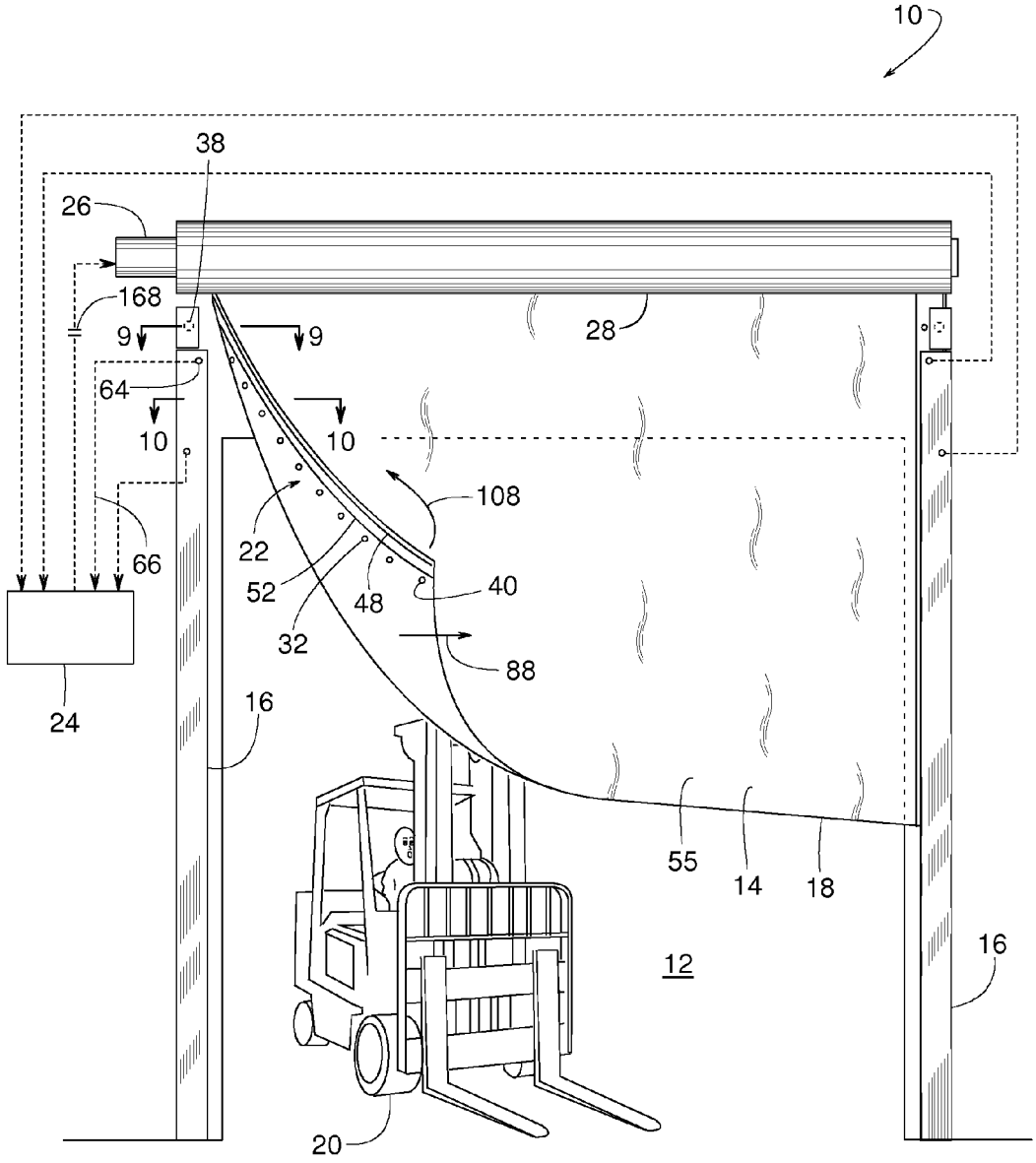
FIG. 4 is a front view similar to FIG. 3 but showing the curtain of the example door in a breakaway state in a nonrestorable condition.
Figure 14:
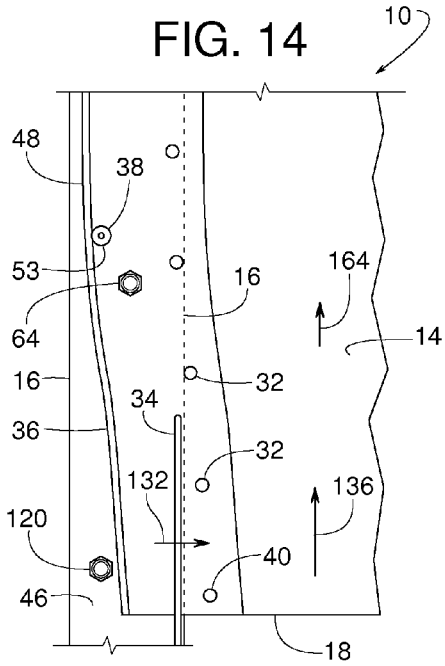
FIG. 14 is a front schematic view of a portion of the example curtain of FIG. 1 in a breakaway state in the restorable condition.

Sometimes a forklift 20 or other material handling equipment might strike the curtain 14, or a collision might occur when the curtain 14 accidentally closes upon an obstacle in its path. To prevent such collisions from damaging the curtain 14, the door 10 includes an example breakaway feature 22 that responds to impacts by allowing the curtain 14 to restorably break away from the track 16. In reaction to collisions, the breakaway feature 22 releases curtain 14 to a breakaway state, wherein the curtain 14 separates at least partially from the track 16. Examples of breakaway states are shown in FIGS. 3, 4 and 14. Depending on the severity of the impact, the curtain 14 in a breakaway state can be in a restorable condition, as shown in FIGS. 3 and 14 or the curtain 14 can be in a nonrestorable condition, as shown in FIG. 4. Consequently, in some examples, the breakaway feature 22 provides two levels of breakaway.

For a first level of breakaway after mild and moderate collisions, as shown in FIGS. 3, 7, 8 and 14 the breakaway feature 22 allows the curtain 14 to automatically return to normal operation (from a breakaway state in a restorable condition to a normal state) by simply powering the door 10 to the open position shown in FIGS. 1, 12, 15 and 16. For a second level of breakaway after severe collisions, such as the one shown in FIGS. 4, 9 and 10, curtain jams are avoided by the controller 24 disabling normal door operation until the door 10 can be manually serviced and/or power operated in some special manner. Manually servicing the door 10, in some examples, involves manually moving a dislodged section of the curtain 14 back within the tracks 16*a*, 16*b*, thereby returning the curtain 14 from a breakaway state in the nonrestorable condition to a normal state.

In the illustrated example, a drive unit 26 (e.g., an electric motor, pneumatic motor, rodless cylinder, etc.) under the command of the controller 24 powers curtain 14 between its open and closed positions while the curtain's weight hanging across the doorway 12 helps keep the curtain 14 taut. When the door 10 is open, the curtain 14 stores in an overhead area 28 that includes some type of the curtain-supporting structure 30. Examples of the curtain-supporting structure 30 include, but are not limited to, a powered rotatable drum about which the curtain 14 wraps, a coiled track, an overhead track, a vertical track, a horizontal track, a curved track, an inclined track, and various combinations thereof.

The track 16 helps support and guide the curtain 14 across the doorway 12. In addition, the track 16 in combination with the curtain 14 provides the breakaway feature 22. To provide the breakaway feature 22, in some examples, the curtain 14 includes a primary projection 32 engaging the primary retainer 34 (FIGS. 5-12) for the first level of breakaway. For a second level of breakaway (FIGS. 4 and 9) and/or for guiding the curtain 14 during a refeed operation (FIGS. 14-16), a secondary projection 36 is laterally confined within the track 16 by a secondary retainer or alignment guide 38. The primary projection 32, in some examples, comprises the plurality of spaced-apart buttons 40 that slide along the primary retainer 34 of the track 16. In the illustrated example, the primary retainer 34 comprises two elongate beads 42 separated by a gap 44. As the buttons 40 travel along the primary retainer 34 during normal door operation, the primary retainer 34 helps hold the buttons 40 within the interior channel 46 of the track 16 and helps guide the curtain's movement.

Figure 5:
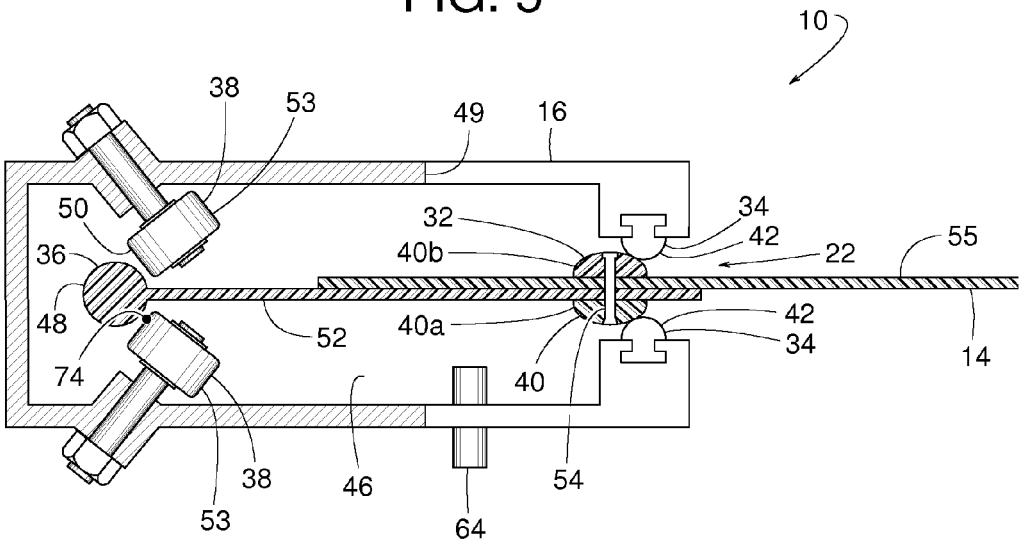
FIG. 5 is a cross-sectional view of the example door of FIG. 2 taken along line 5-5 of FIG. 2.
Figure 6:
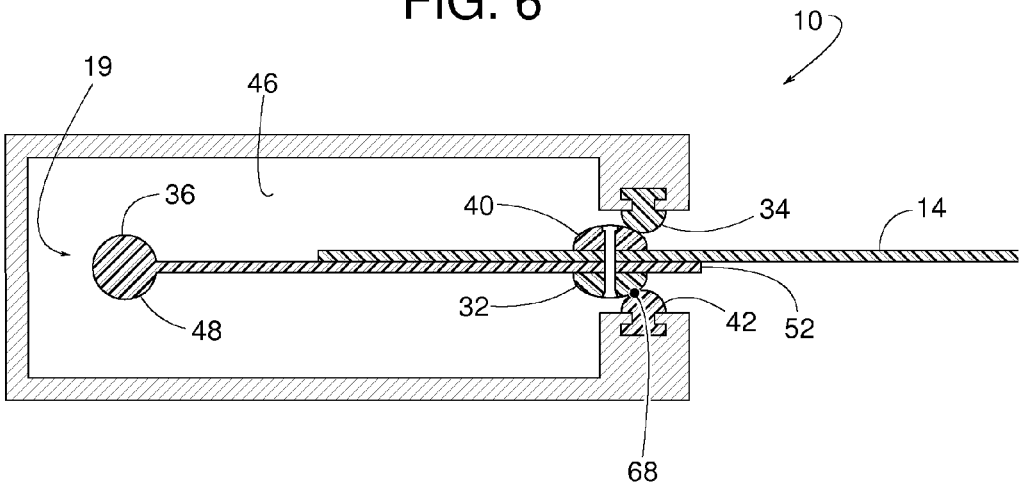
FIG. 6 is a cross-sectional view of the example door of FIG. 2 taken along line 6-6 of FIG. 2.

The curtain's secondary projection 36, in some examples, is the elongate bead 48 that travels past the alignment guide 38 of the track 16. In the illustrated example, the alignment guide 38 is mounted to a bracket 49 and comprises two rollers 53 each of which have an outer diameter 50 that rolls lightly against or is in proximity with the secondary projection 36 as the door 10 opens and closes. In some examples, the roller 53 has an axle tilted relative to the face of the curtain 14, as shown in FIG. 5. In other examples, the roller's axle is perpendicular to the curtain 14. In some examples, secondary projection 36 is an integral part of an edging 52 that is ultrasonically welded, bonded or otherwise connected to a sheet portion 55 of the curtain 14. In the illustrated example where the primary projection 32 is in the form of a button, the rivet 54 connects two button halves 40*a* and 40*b* together with the edging 52 and the sheet 54 being clamped between the button halves 40*a* and 40*b*. In some examples, the rivet 54 or an alternate fastener is of limited strength to serve as a readily replaceable shear pin or "weakest link" that breaks before other more expensive door parts can be damaged. Some examples of the button 40 include, but are not limited to, a 24/Nylon Cap w/Burr, Matte Black, YKK part number Y88B119A01Y; and a 24/Nylon Cap, Matte Black, YKK part number M77B119A01Y; both of which are provided by YKK Inc., of Marietta, Ga.

Figure 7:
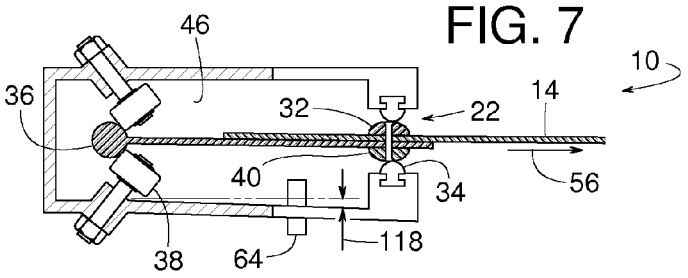
FIG. 7 is a cross-sectional view of the example door of FIG. 3 taken along line 7-7 of FIG. 3.
Figure 8:
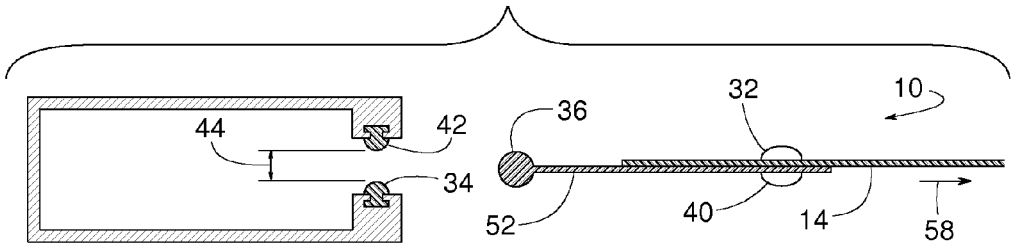
FIG. 8 is a cross-sectional view of the example door of FIG. 3 taken along line 8-8 of FIG. 3.

Mild and moderate collisions, as shown in FIGS. 3, 7 and 8 can create curtain tension sufficient to forcibly pull the primary projection 32 out from within channel 46 through the gap 44. Even though the primary projection 32 is larger than the gap 44, curtain tension exerting a first force 56 can still pull the primary projection 32 through the gap 44 due to the flexibility of certain door parts, such as the primary retainer 34, the primary projection 32, and/or the sidewalls of the track 16 (note the track deflection 118 in FIG. 7). In some examples, once the primary projection 32 passes through the gap 44, curtain tension can exert a reduced second force 58 (equal to or greater than zero) that pulls the secondary projection 36 though the gap 44, as shown in FIG. 8.

Under mild and moderate collisions sufficient to dislodge the primary projection 32 a first extent, as shown in FIGS. 3, 8 and 14 the secondary projection 36 remains laterally confined within the track 16 near the top of the door because of the alignment guide 38, as shown in FIGS. 5, 7 and 14. In some examples, to reduce (e.g., minimize) wear and friction, the secondary projection 36 is slightly separated from the alignment guide 38 during normal operation, as shown in FIGS. 5 and 13. With the secondary projection 36 confined within the track 16, the door 10 can be returned to normal operation using a refeed operation. In some examples, the refeed operation involves opening the door 10 as the alignment guide 38 uses the secondary projection 36 to the guide curtain 14 back onto the curtain supporting structure 30 with the dislodged primary projection 32 being realigned with the track 16. The drive unit 26 continues opening the door 10 until leading edge 18 rises above the primary retainer's upper ends 60, as shown in FIGS. 12 and 15. With the curtain 14 at this height, a refeed opening 62 just above the primary retainer 34 allows the curtain's leading edge 18 to readily slip back into its proper position within the channel 46. Subsequently lowering the curtain 14 feeds the primary projection 32 back down through the channel 46, such that the primary projection 32 is back within the confines of the primary retainer 34.

FIGS. 13-16 schematically illustrate an example refeed operation. FIG. 13 shows the door 10 during normal operation with the curtain 14 in a normal state. During normal operation, the primary projection 32 is retained and guided by the primary retainer 34, and the secondary projection 36 and the alignment guide 38 play a generally passive role. During normal operation, the curtain's leading edge 18 travels within the limits of a maximum (e.g., normal) acceleration and speed (first speed).

FIG. 14 shows the curtain 14 dislodged to a breakaway state in a restorable condition. In the illustrated example, the breakaway state means that at least some of the buttons 40 have been forced out from within the track 16, and the restorable condition means that the roller 53 still has the bead 48 laterally confined within the track 16 (e.g., laterally confined by the alignment guide). Curtain strain created by buttons 40 being forced out of the track 16 to the wrong side of the primary retainer 34 forces the bead 48 up against the roller 53, as shown in FIG. 14. The buttons 40 escaping the track 16 through the gap 44 (FIG. 12) helps protect the curtain 14 from damage. In some examples, to further avoid damage, the curtain/edging sensor 120 (second sensor) is installed below the primary retainer's upper end 60 to detect the curtain 14 moving to the breakaway state, even during mild breakaways. In some examples, the sensor 120 is installed about 24 inches below the roller 53. In response to a signal 122 (FIG. 1) from the sensor 120 indicating a breakaway, controller 24 limits or decelerates the curtain's leading edge 18 to a reduced speed (second speed) that is appreciably less than the normal speed (first speed) of normal operation. In some examples, where a mild breakaway occurs, only the buttons 40 located near the leading edge 18 of the door 10 may have become dislodged (e.g., towards the bottom of the door 10). In such examples, the sensor 120 located near the alignment guide 38 (towards the top of the doorway 12) enables the door 10 to close at a normal speed during most of the door's travel until the portion of the door 10 that has become dislodged is detected by the sensor, at which point the speed is reduced. In this manner, the door 10 is repositioned at a speed that reduces the risk of damage but still opens at a relatively fast rate.

After being dislodged from the position shown in FIG. 14, an example refeed operation begins with the curtain's leading edge 18 traveling at a reduced speed up to the position shown in FIG. 15. As the curtain's leading edge 18 rises from the position shown in FIG. 14 to the position shown in FIG. 15, the roller 53 engaging the bead 48 guides the curtain 14 back onto or into the curtain supporting structure 30 (schematically depicted in FIG. 1).

Once the curtain 14 reaches the elevation shown in FIG. 15, the refeed opening 62 above the primary retainer 34 allows the curtain's leading edge 18 to readily slip back into its proper position within the channel 46, as shown in FIG. 16. Subsequently the lowering curtain 14 feeds the primary projection 32 back down through the channel 46 such that the primary projection 32 is back within the confines of the primary retainer 34, thereby returning the curtain 14 to its normal state. With the curtain 14 back in the normal state, in some examples, the bead 48 is once again slightly spaced apart from the roller 53 to reduce wear and friction. So, in some examples, the alignment guide 38 and the secondary projection 36 play an active role during the refeed operation, but they have an inactive role during normal operation.

Figure 9:
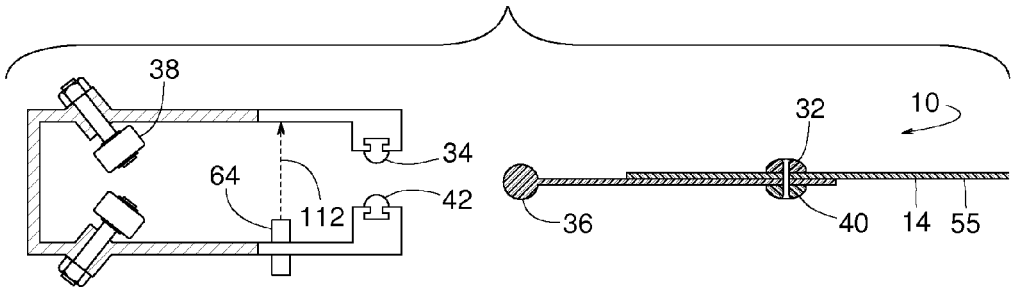
FIG. 9 is a cross-sectional view of the example door of FIG. 4 taken along line 9-9 of FIG. 4.
Figure 10:
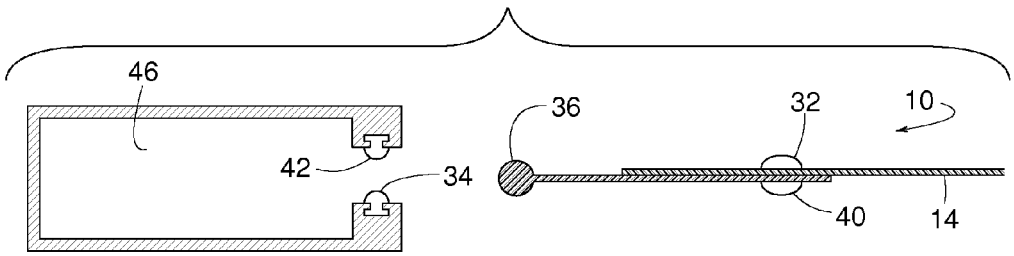
FIG. 10 is a cross-sectional view of the example door of FIG. 4 taken along line 10-10 of FIG. 4.
Figure 11:
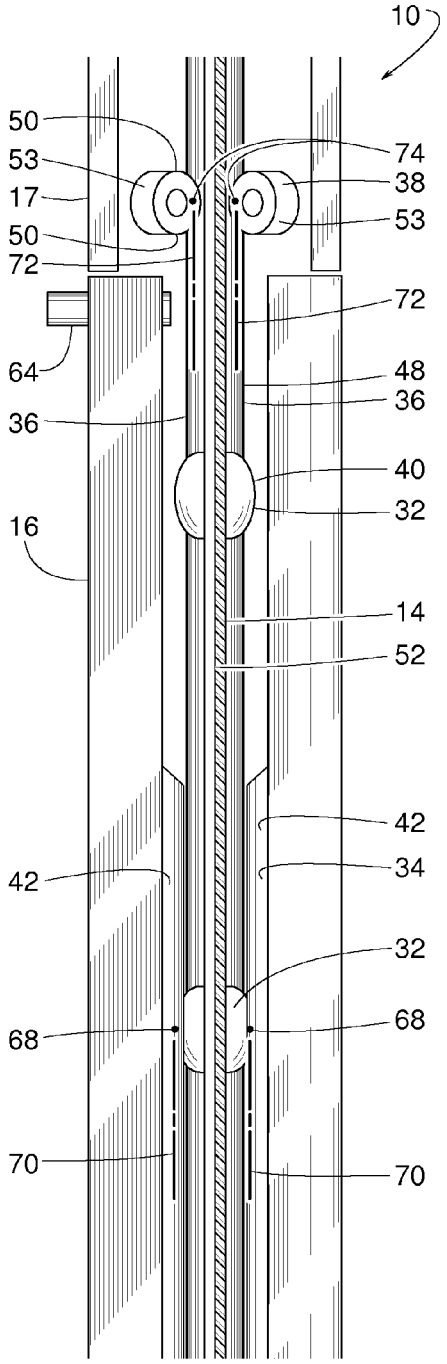
FIG. 11 is a cross-sectional view of the example door of FIG. 2 taken along line 11-11 of FIG. 2.

Severe collisions can dislodge the primary projection 32 from the primary retainer 34 to a second extent greater than the first extent that further dislodges the secondary projection 36 from the alignment guide 38, as shown in FIGS. 4, 9 and 10. Under such conditions, attempting to automatically return the curtain's leading edge 18 back through the refeed opening 62 by having the drive unit 26 electromechanically power the door 10 open and closed might seriously jam the curtain 14 within the track 16 and/or within the curtain-support structure 30. Such a jam can be difficult to undo and can permanently damage the door 10. Consequently, some examples of the controller 24 restrict or inhibit normal door operation until the secondary projection 36 is manually or otherwise repositioned in proper engagement with the alignment guide 38.

To detect whether a severe collision places the curtain 14 in the breakaway state in the nonrestorable condition, some examples of the door 10 include the curtain/edging sensor 64 (first sensor) in sensing proximity with the curtain 14 so as to sense the curtain's position within the track 16, particularly in the area of the alignment guide 38. Although the sensor 64 of the illustrated example is shown closer to the center of the curtain 14, in some examples, the sensor 64 is positioned at substantially the same distance from the center of the curtain 14 (e.g., directly below the alignment guide 38). In some examples, the sensor 64 is in a first state (e.g., a signal 66 indicating a set of electrical contacts being closed) when the sensor 64 detects the presence of the edging 52 properly positioned near the alignment guide 38, and the sensor 64 is in a second state (e.g., the signal 66 indicating the electrical contacts are open) when the sensor 64 does not detect the presence of the edging 52 near the alignment guide 38. Some examples of the sensors 120, 64 include, but are not limited to, a photoelectric eye and an electromechanical limit switch. More specific examples of the sensors 120, 64 include a part number XUVR0303PANL2 photoelectric fork sensor provided by Schneider Electric (Telemecanique) of Palatine, Ill.; and a type OBT15-R2-E2, part number 225916 background suppression sensor provided by Pepperl and Fuchs of Twinsburg, Ohio. In some examples, the second sensor 120 is installed below the first sensor 64 so that the sensors 120, 64 can distinguish a restorable breakaway, a nonrestorable breakaway, and a normal state.

In response to the signal 66 indicating that the sensor 64 is in the first state, the controller 24 allows normal door operation. With the sensor 64 in the first state, the curtain 14 can be either in the normal state or can be in the breakaway state in the restorable condition. Either way, the controller 24 allows the door 10 to open. So, in some examples, the sensor 64 ignores, disregards or is otherwise unresponsive to the curtain 14 moving from the normal state to the breakaway state in the restorable condition.

In response to the signal 66 indicating that the sensor 64 is in the second state, the controller 24 determines that the curtain 14 is in the breakaway state in the nonrestorable condition. In this situation, the controller 24 inhibits or restricts operation of the door 10. For instance, in some examples, the controller 24 disables electromechanical operation of the door 10 until the curtain 14 is manually returned either to its normal state or to its breakaway state in the restorable condition.

Although the design and material properties of the curtain 14, the edging 52, the projections 32, 36, and retainers 34, 38 may vary, some examples of the curtain 14 comprise a pliable sheet of vinyl or polyurethane. The term, "curtain" refers to any assembly, panel or sheet of material that is sufficiently flexible to restorably break away from its guide tracks without the assembly, panel or sheet of material experiencing significant permanent damage. Some examples of the curtain 14 comprise an assembly of multiple sheets. In some examples, the primary projection 32 is made of nylon for its hardness and durability. In some examples, the primary projection 32 is harder and more durable than the primary retainer 34 to take advantage of a worn primary retainer 34 being easier to replace than a series of worn primary projections 32. In some examples, the primary retainer 34 is made of UHMW (ultra high molecular weight polyethylene) for its low coefficient of friction with nylon and other materials. In some examples, the secondary projection 36 is made of urethane for its durability and flexibility at low temperatures. In some examples, the primary projection 32 is harder than the secondary projection 36 so that the secondary projection 36 can readily coil when the door 10 opens, and the relatively hard primary projection 32 has minimal dimensional distortion to maintain a constant pullout force through the gap 44.

In examples where the primary projection 32 comprises a plurality of spaced-apart projections (e.g., the buttons 40), the space between the projections allows the curtain 14 to coil upon itself more compactly. Moreover, the primary projection 32 comprising a plurality of spaced-apart projections sliding along a generally linear primary retainer 34 creates a point of contact 68 (FIGS. 6 and 11) on the primary projection 32 that moves as the door 10 operates and creates a substantially stationary line of contact 70 (FIG. 11) on the primary retainer 34. The contact on the primary retainer 34 being along a line broadly and evenly distributes the wear on the relatively soft primary retainer 34, and the point of contact 68 is focused on a relatively hard, durable primary projection 32.

In examples where the secondary projection 36 is an elongate bead (e.g., the bead 48) with a traveling line of proximity 72 (FIG. 11) adjacent to and sometimes in contact with the roller 53, wear along the relatively soft bead 48 is broadly and evenly distributed along the line 72, and a point of contact 74 on the roller 53, for example, is focused on a very hard, durable alignment guide 38. Thus, the secondary projection 36 being longer than the alignment guide 38 strategically balances the wear between them. Likewise, the primary retainer 34 being longer than the primary projection 32 provides a similar benefit.

Although the physical orientation and relative locations of the various door parts may vary, in some examples, the alignment guide 38 is above the primary retainer 34, and a central region 76 of doorway 12 is closer to the primary projection 32 than to the secondary projection 36. This allows the primary projection 32 to break away without the secondary projection 36 necessarily breaking away with the primary projection 32. In some examples, the sensor 64 is closer to the leading edge 18 when in the open position (FIG. 1) than to the leading edge when in the closed position (FIG. 2) to allow a partially open curtain 14 to break away to a restorable condition without tripping the sensor 64 unnecessarily. The separation and relative location of the projections 32, 36 and retainers 34, 38 help in distinguishing a restorable condition from a nonrestorable condition. More specifically, in some examples, the alignment guide 38 is both vertically and horizontally offset relative to the primary retainer 34, and the alignment guide 38 is higher than the primary retainer 34. In some examples, as shown in FIG. 12, the primary projection 32 is spaced apart from the primary retainer 34 when the curtain's leading edge 18 is in the open position, thereby allowing the curtain 14 to return itself within the channel 46 of the track 16.

FIG. 17 is a truth table 1700 showing example states of the curtain determined based on feedback signals 66, 122 from the sensors 64, 120. As shown in the illustrated example of FIG. 17, when the signal 66 is in a tripped state (e.g., signal 66=true), when the sensor 64 does not detect the presence of the edging 52 near the alignment guide 38, the curtain 14 may be determined to be in a breakaway state associated with the non-restorable condition regardless of the state of the second signal 122 (e.g., second signal can be either true or false). However, in some examples, when the signal 66 is in an untripped state (e.g., signal 66=false) the state of the curtain 14 is determined based on the signal 122. In particular, as shown in the illustrated example, when signal 122 is in an untripped state (e.g., signal 122=false) associated with the presence of the edging 52 properly positioned within the track 16, the curtain 14 is identified as being in a normal state. In some examples, where the signal 122 is in a tripped state (e.g., signal 122=true) the curtain 14 is identified as being in a breakaway state associated with the restorable condition (assuming the signal 66 is false). Based on the truth table 1700, in some examples, the signal 122 will be tripped each time the leading edge 18 of the curtain 14 raises above the second sensor 120 even when the edging 52 is properly situated within the track 16 resulting in an incorrect indication of a breakaway state. Accordingly, in some such examples, the controller 24 monitors the position of the leading edge 18 (e.g., by additional sensors or by counting the rotations of the drive unit 26) and ignores the signal 122 when the leading edge is above the sensor 120. In some examples, the speed of the door 10 when opening is configured to slow down as the door 10 reaches the fully open position regardless of whether the curtain 14 is in a breakaway state. Accordingly, in some examples, the leading edge 18 of the curtain rising about the second sensor 120 is used as an indicator that the door 10 is nearly fully open. In some examples, the controller 24 analyzes the signals 66, 122 from each side of the door 10 independently to identify which side of the curtain 14 is dislodged (or whether both sides of the curtain 14 are dislodged) when in a breakaway state. In some examples, additional sensors are used to monitor the state of the curtain 14. For instance, in some examples, multiple sensors 120 are placed at varying heights along the track 16 to detect the height at which the edge of the curtain 14 dislodges from the track.

As described previously, in some examples, the edge bead 48 or secondary projection 36 has a continuous cross-sectional profile which is thicker than the curtain 14. In some examples, as the curtain 14 is being wound around a rollup drum to open the door 10, the curtain 14 will walk or shift back and forth on the drum to avoid a localized buildup in the winding of the curtain 14 due to the thickness of the edge bead 48. In some such examples, this movement by the curtain 14 along the rollup drum can create a challenge in opening and closing the door 10. For instance, if the curtain 14 shifts too far along the rollup drum, excessive loads can be applied to the curtain 14 from the alignment guides 38 or guide rollers 53, thereby potentially resulting in fatigue and/or excess wear on the edge bead 48. Example solutions to this challenge are shown and described in connection with FIGS. 18-22.

Figure 18:
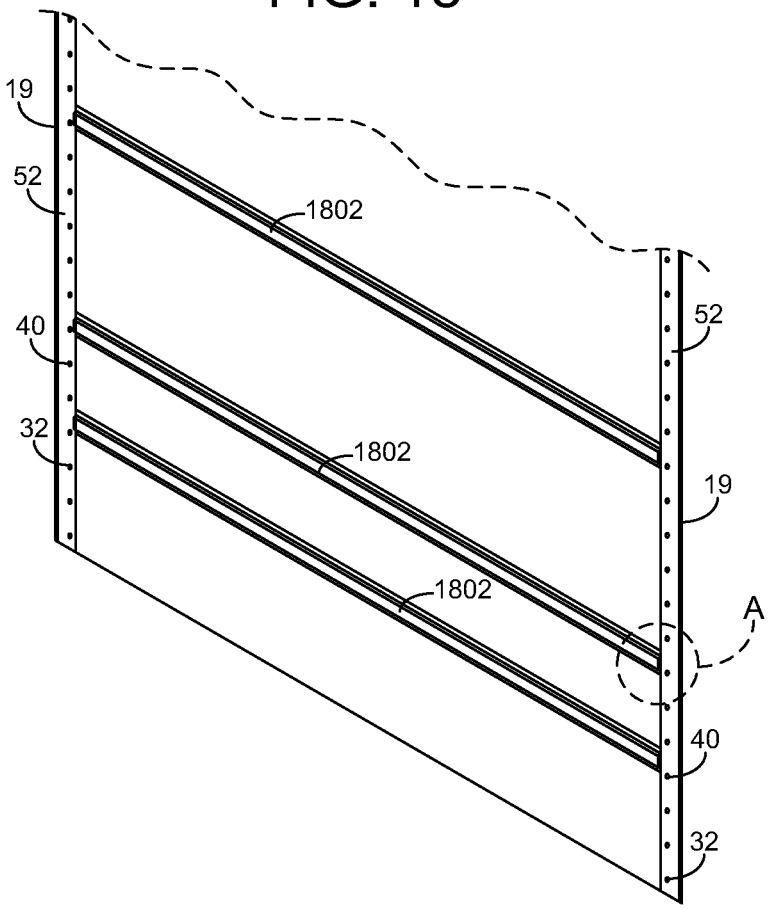
FIG. 18 illustrates an example curtain with stiffeners for the example door of FIGS. 1-4.
Figure 19:
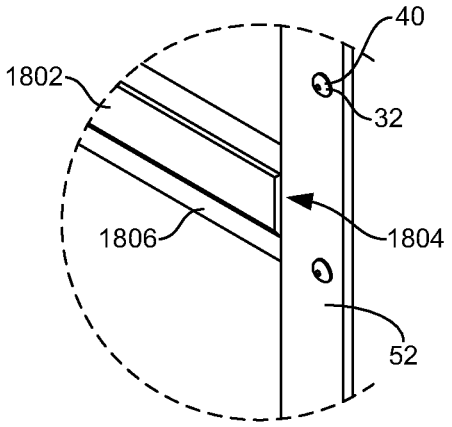
FIG. 19 is an enlarged view of the portion of the example curtain of FIG. 18 within the circle A.

FIG. 18 illustrates an example curtain 14 with stiffeners 1802 for use with the example door 10 of FIG. 1. FIG. 19 is an enlarged view of the portion of the example curtain 14 within the circle A of FIG. 18. In the illustrated examples, multiple stiffeners 1802 are attached to the curtain 14 at various heights along the curtain 14 to substantially extend across the curtain 14 between the opposing lateral edges 19. In some examples, the stiffeners 1802 extend up to the edging 52 on either side of the curtain 14. The stiffeners 1802 in the illustrated example may be formed of any suitable material (e.g., fiberglass) that is stiffer than the material of the curtain 14 to keep the edges 19 of the curtain 14 forced outboard when the curtain 14 is wound around the rollup drum to reduce the risk of the edge bead 48 being forced tightly against the alignment guides 38. However, in some examples, the material (e.g., fiberglass) of the stiffeners 1802 also has some flexibility so that the curtain 14 may still absorb an impact to dislodge the primary projections 32 or buttons 40 from the track 16 without permanently damaging the door 10. Such flexibility, on the one hand, and stiffness, on the other hand, is made possible in part because the curtain 14 wraps around itself on the rollup drum when the door is being opened, thereby limiting the ability of the stiffeners 1802 to bend or flex to provide the desired outboard force on the edges 19 of the curtain 14.

As shown in FIG. 19, the stiffeners 1802 of the illustrated example are attached to the curtain 14 via pockets 1804 formed from a strip of fabric 1806. Specifically, the pockets 1804 are formed by connecting an upper and lower portion of each strip of fabric 1806 to the curtain via any appropriate technique (e.g., stitching, ultrasonically welding, bonding, etc.) thereby leaving a gap wherein the stiffener 1802 may be inserted. In some examples, after the stiffener 1802 is inserted into the pocket 1804, each end of the strip of fabric 1806 is also connected to the curtain 14 to enclose the stiffener 1802 and secure it in place.

Figure 20:
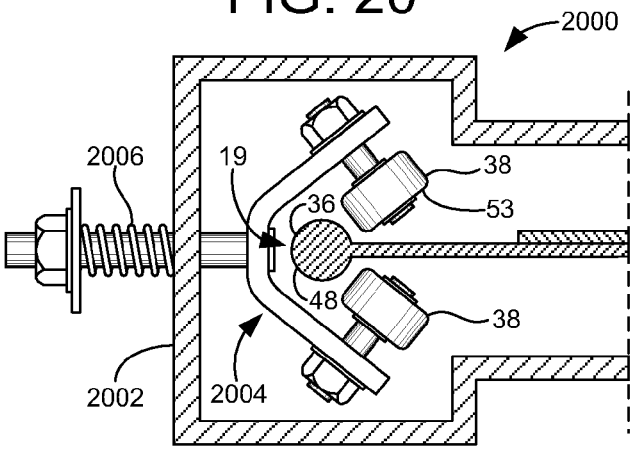
FIGS. 20-22 are cross-sectional views of an example floating alignment guide bracketing system for the example door of FIGS. 1-4.
Figure 21:
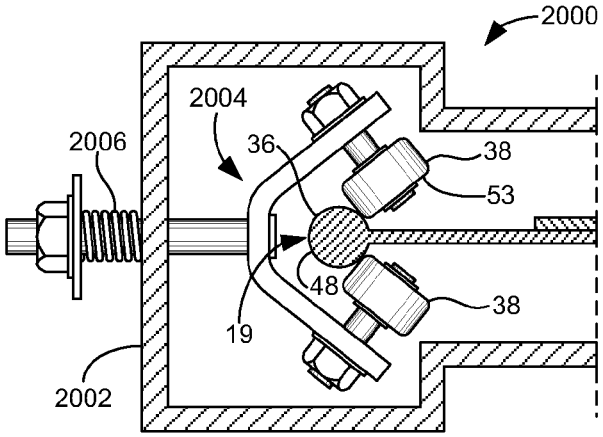
Figure 22:
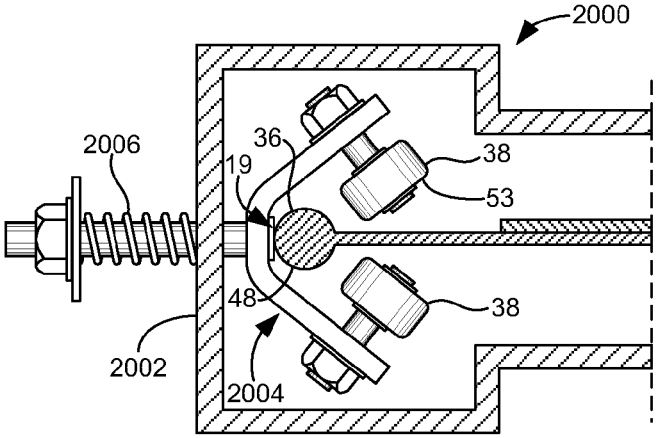

FIGS. 20-22 are cross-sectional views of an example floating alignment guide bracketing system 2000 for the example door 10 of FIGS. 1-4. In the illustrated examples, the bracketing system 2000 includes a stationary bracket 2002 (similar to the bracket 49 of FIG. 5) and a sliding bracket 2004 that can translate in the plane of the curtain 14 relative to the stationary bracket 2002. Additionally, in some examples, the bracket system 2000 also contains one or more springs 2006 to bias the sliding bracket 2004 to a default or normal position (FIG. 20) relative to the stationary bracket 2002. In some examples, the bracketing system 2000 is configured to enable the sliding bracket 2004 to move inward toward the central region 76 of the doorway 12 (FIG. 21) relative to the stationary bracket 2002. Additionally or alternatively, in some examples, the bracketing system 2000 is configured to enable the sliding bracket 2004 to move outward away from the central region 76 of the doorway 12 (FIG. 22) relative to the stationary bracket 2002.

In the illustrated examples of FIGS. 20-22, the alignment guides 38 are attached to the sliding bracket 2004 such that the alignment guide 38 can float or follow the movement of the edge 19 of the curtain 14 as it moves along the rollup drum to account for the thickness of the secondary projection 36 or edge bead 48. In some examples, as shown in FIG. 20, when the curtain 14 is operating normally and/or the curtain 14 is centrally aligned on the rollup drum, the default position of the sliding bracket 2004 is such that the edge bead 48 passes the alignment guide 38 without contact thereby reducing the amount of wear on the edge bead 48. However, in some such examples, if the edge 19 of the curtain begins to wander inwards as the curtain 14 is being rolled or unrolled around the drum, the spring 2006 will compress such that the sliding bracket 2004 will also move inwards to enable the alignment guide 38 to follow the edge 19 and reduce the load from the alignment guide 38 on the edge bead 48 as shown in FIG. 21. In contrast, in some examples, the spring 2006 may expand when the edge 19 of the curtain 14 moves outwards such that the sliding bracket 2004 will also move outwards to again enable the alignment guide 38 to follow the edge bead 48 as shown in FIG. 22.

Figure 23:
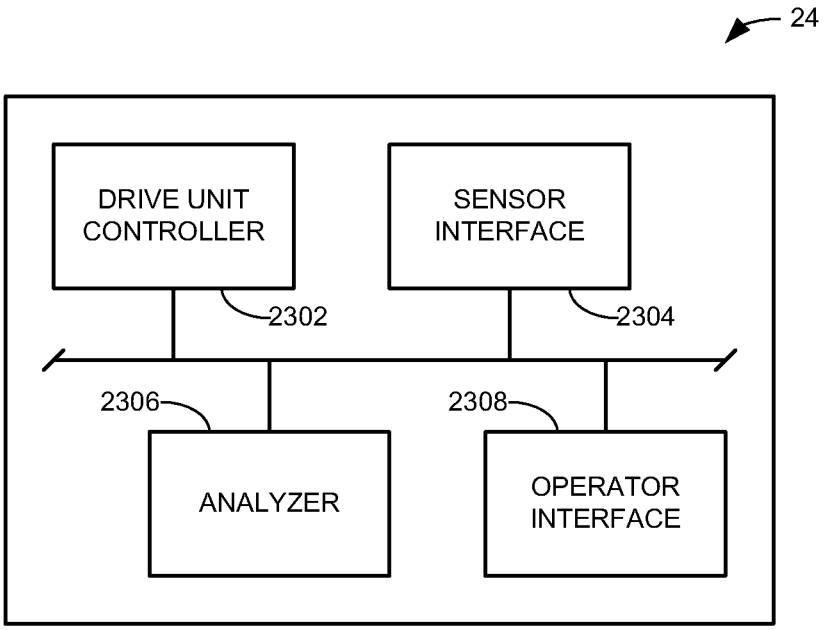
FIG. 23 is a block diagram of an example implementation of the example controller of FIGS. 1-4.

FIG. 23 is a block diagram of an example implementation of the example controller 24 of FIGS. 1-4. As shown in the illustrated example, the controller 24 comprises an example drive unit controller 2302, an example sensor interface 2304, an example analyzer 2306, and an example operator interface 2308. In some examples, the drive unit controller 2302 controls (e.g., speed and direction) the drive unit 26 of the example door 10. In some examples, the drive unit controller 2302 also monitors a position of the leading edge 18 of the curtain 14 to track an extent to which the door 10 is opened or closed.

In the illustrated example, the controller 24 is provided with the example sensor interface 2304 to communicate with the sensors 64, 120 and receive the corresponding feedback signals 66, 122 indicative of the breakaway state of the curtain 14. The example analyzer 2306 is provided in the illustrated example to analyze the signals 66, 122 to distinguish between a breakaway state in a nonrestorable condition from a restorable condition as well as to determine when the curtain 14 is in a normal operational state. The example controller 24 is provided with the example operator interface 2308 to communicate with an operator. For example, when the analyzer 2306 detects that the curtain 14 is in a nonrestorable breakaway state, the controller 24 may provide an alert to an operator via the operator interface 2308. In some examples, an operator provides instructions to the controller 24 via the operator interface (e.g., speed adjustments to be provided to the drive unit controller 2302).

While an example manner of implementing the example controller 24 of FIGS. 1-4 is illustrated in FIG. 23, one or more of the elements, processes and/or devices illustrated in FIG. 23 may be combined, divided, re-arranged, omitted, eliminated and/or implemented in any other way. Further, the example drive unit controller 2302, the example sensor interface 2304, the example analyzer 2306, the example operator interface 2308, and/or, more generally, the example controller 24 of FIG. 23 may be implemented by hardware, software, firmware and/or any combination of hardware, software and/or firmware. Thus, for example, any of the example drive unit controller 2302, the example sensor interface 2304, the example analyzer 2306, the example operator interface 2308, and/or, more generally, the example controller 24 could be implemented by one or more analog or digital circuit(s), logic circuits, programmable processor (s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, X, the example drive unit controller 2302, the example sensor interface 2304, the example analyzer 2306, and/or the example operator interface 2308 is/are hereby expressly defined to include a tangible computer readable storage device or storage disk such as a memory, a digital versatile disk (DVD), a compact disk (CD), a Blu-ray disk, etc. storing the software and/or firmware. Further still, the example controller 24 of FIGS. 1-4 may include one or more elements, processes and/or devices in addition to, or instead of, those illustrated in FIG. 23, and/or may include more than one of any or all of the illustrated elements, processes and devices.

Flowcharts representative of example machine readable instructions for implementing the controller 24 of FIGS. 1-4 are shown in FIGS. 24-26 and 35. In these examples, the machine readable instructions comprise programs for execution by a processor such as the processor 2712 shown in the example processor platform 2700 discussed below in connection with FIG. 27. The program may be embodied in software stored on a tangible computer readable storage medium such as a CD-ROM, a floppy disk, a hard drive, a digital versatile disk (DVD), a Blu-ray disk, or a memory associated with the processor 2712, but the entire program and/or parts thereof could alternatively be executed by a device other than the processor 2712 and/or embodied in firmware or dedicated hardware. Further, although the example programs are described with reference to the flowcharts illustrated in FIGS. 24-26 and/or 35, many other methods of implementing the example controller 24 may alternatively be used. For example, the order of execution of the blocks may be changed, and/or some of the blocks described may be changed, eliminated, or combined.

As mentioned above, the example processes of FIGS. 24-26 and/or 35 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example processes of FIGS. 24-26 and/or 35 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disk and to exclude propagating signals. As used herein, when the phrase at "least" is used as the transition term in a preamble of a claim, it is open-ended in the same manner as the term "comprising" is open ended.

Figure 24:
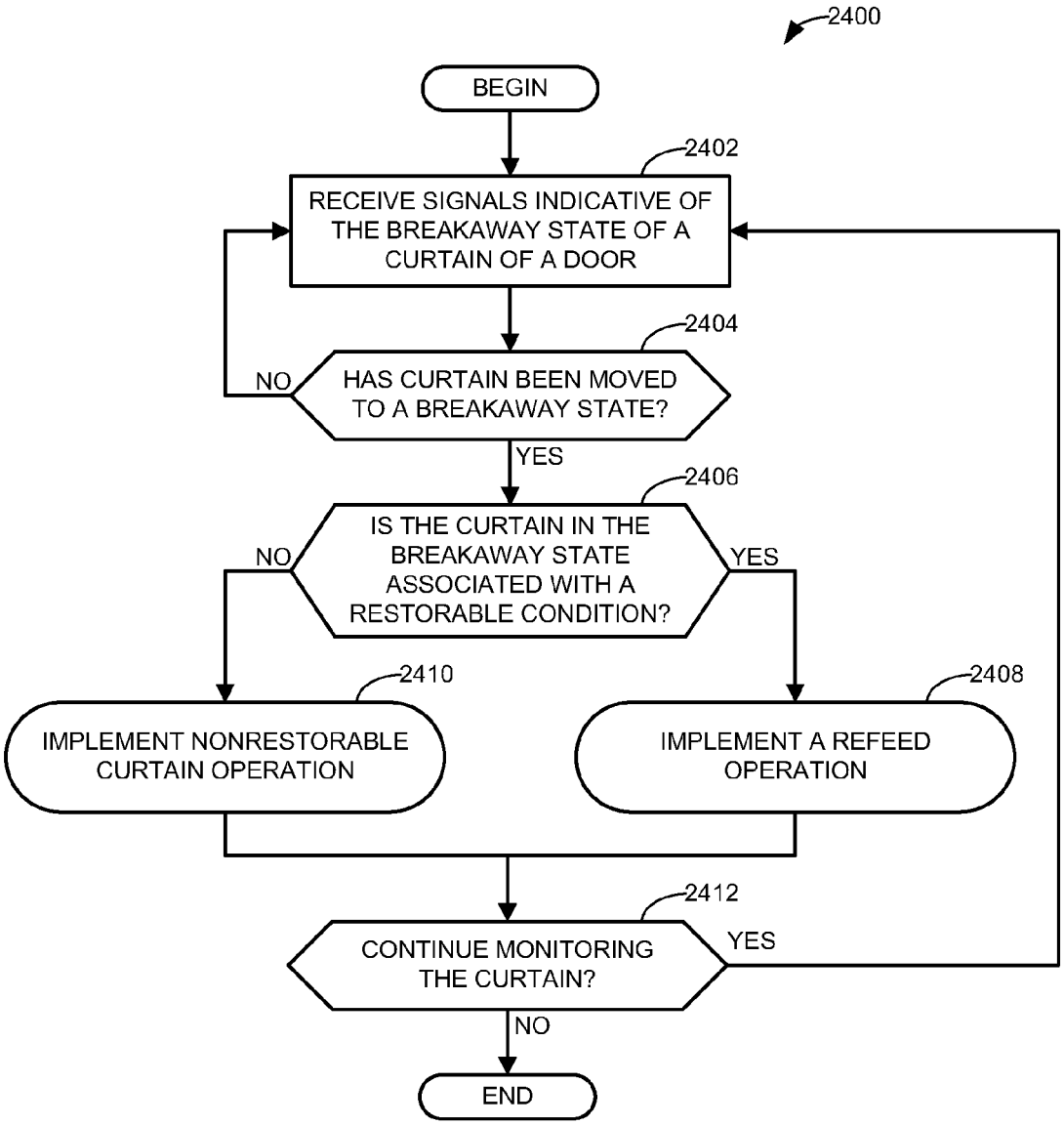
FIG. 24 is a block diagram illustrating an example method in accordance with the teachings disclosed herein.

In particular, FIG. 24 shows an example method 2400 of using the example door 10. The method blocks shown in FIG. 24 are not necessarily in any particular sequential order. In some examples, one or more of the actions shown in FIG. 24 can be omitted, implemented simultaneously with other blocks, and/or implemented in a different order. The example method begins at block 2402 where the example sensor interface 2304 receives signals (e.g., via the sensors 64, 120) indicative of the breakaway state of the curtain 14 of the door 10. At block 2404, the example analyzer 2306 determines whether the curtain 14 has been moved to a breakaway state. In some examples, the curtain 14 may be moved to a breakaway state associated with either a restorable position or a nonrestorable condition. The restorable condition, in some examples, corresponds to the primary projection 32 being dislodged or removed from the primary retainer 34 while the secondary projection 36 remains confined by the alignment guide 38. For example, arrow 84 of FIG. 3 and arrow 132 of FIG. 14 represent the curtain 14 being moved to a breakaway state associated with the restorable condition (e.g., by an impact on the curtain 14 that causes a force sufficient to pull the primary projection 32 from the primary retainer 34). The nonrestorable condition, in some examples, corresponds to the secondary projection 36 being dislodged or displaced from lateral confinement by the alignment guide 38 in addition to the primary projection 32 being dislodged from the primary retainer 34. For example, arrow 88 of FIG. 4 represents the curtain 14 being moved to a breakaway state associated with the nonrestorable condition (e.g., by an impact on the curtain 14 that causes a force sufficient to pull the primary projection 32 from the primary retainer 34 and the secondary projection 36 from the alignment guide 38). The example analyzer 2306 determines whether the curtain 14 has been moved to a breakaway state in either the restorable or nonrestorable condition based on signals from the first sensor 64 and/or the second sensor 120. If the analyzer 2306 determines (at block 2404) that the curtain 14 has not been moved to a breakaway state (i.e., the curtain has remained in the normal state), the example method returns to block 2402 to continue monitoring the signals 66, 122 indicative of the breakaway state of the curtain 14. If the example analyzer 2306 determines that the curtain 14 has been moved to a breakaway state, the example method advances to block 2406.

At block 2406, the example analyzer 2306 determines whether the curtain 14 is in a breakaway state associated with a restorable condition (or is associated with a nonrestorable condition). In some examples, the example analyzer 2306 determines that the curtain 14 is in the breakaway state associated with the nonrestorable condition based on a signal (e.g., the signal 66 of FIG. 1) from the first sensor 64 detecting the displacement of the secondary projection 36 from lateral confinement by the alignment guide 38 (e.g., the arrow 112 of FIG. 9 represents the sensor 64 detecting the curtain 14 moving to the breakaway state in the nonrestorable condition). In some examples, the example analyzer 2306 determines that the curtain 14 is in the breakaway state associated with the restorable condition based on a signal (e.g., the signal 122 of FIG. 1) from the second sensor 120 detecting the displacement of the edge 19 of the curtain 14 outside the track 16 (e.g., as the primary projection 32 is dislodged from the primary retainer 34), while the signal 66 from the first sensor 64 indicates the secondary projection 36 remains positioned behind the alignment guide 38.

If the example analyzer 2306 determines that the curtain has moved to the breakaway state in the restorable condition (block 2406), control advances to block 2408 where the example controller 24 implements a refeed operation. An example implementation of the refeed operation of block 2408 is shown and described below in connection with FIG. 20. If the example analyzer 2306 determines (at block 2406) that the curtain 14 has not moved to the breakaway state in the restorable condition (i.e., the curtain 14 has moved to the breakaway state in the nonrestorable condition), control advances to block 2410 where the example controller 24 implements a nonrestorable curtain operation. An example implementation of the nonrestorable curtain operation of block 2410 is shown and described below in connection with FIG. 21. At block 2412, the example analyzer 2306 determines whether to continue monitoring the curtain 14. If the example analyzer 2306 determines to continue monitoring the curtain 14, control returns to block 2402. If the example analyzer 2306 determines not to continue monitoring the curtain 14, the example method of FIG. 24 ends.

Figure 25:
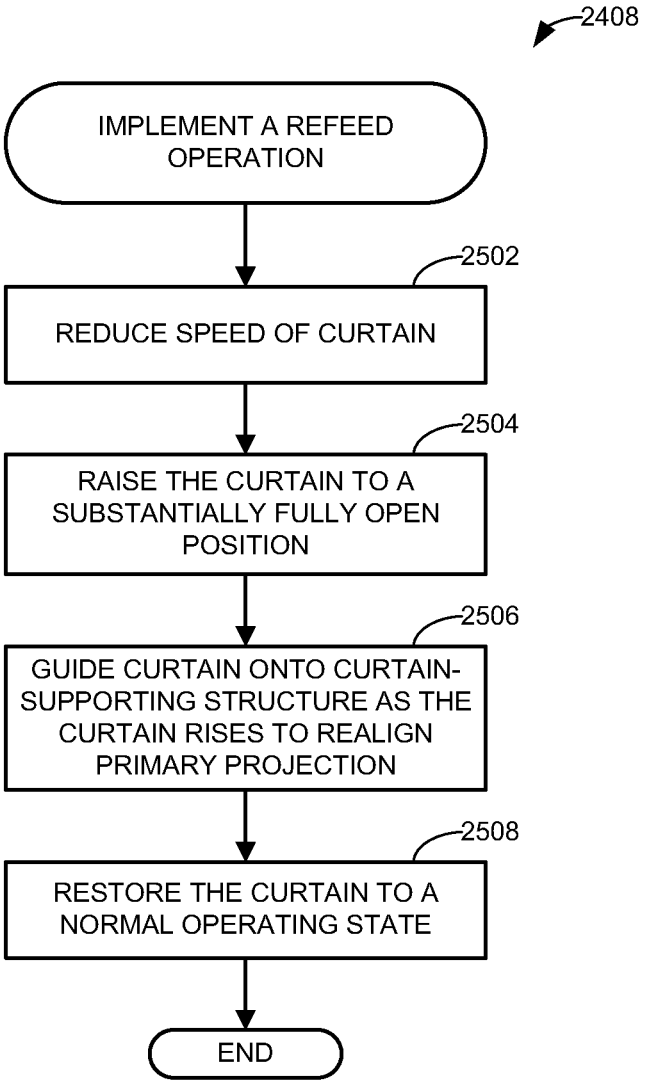
FIG. 25 is a block diagram illustrating another example method in accordance with the teachings disclosed herein.

FIG. 25 shows an example method corresponding to block 2408 of the example method 2400 of FIG. 24 to implement a refeed operation. The method blocks shown in FIG. 25 are not necessarily in any particular sequential order. In some examples, one or more of the blocks shown in FIG. 25 can be omitted, implemented simultaneously with other blocks, and/or implemented in a different order. The example method begins at block 2502 where the example drive unit controller 2302 reduces the speed of the curtain 14. For example, during normal operations when the curtain 14 is in a normal state, the curtain 14 is driven at a normal (full) speed (e.g., represented by arrow 160 of FIG. 13). In contrast, during the refeed operation (e.g., after detecting a restorable condition of the curtain 14), the curtain 14 is driven at a reduced (slower) speed (e.g., represented by arrow 164 of FIG. 14, which is shorter than arrow 160 of FIG. 13). The reduced speed of the curtain 14 in such examples enables greater control in refeeding the primary projection 32 described below. At block 2504, the example drive unit controller 2302 raises the curtain 14 to a substantially fully open position. For example, the example drive unit controller 2302 electromechanically raises the curtain 14 (e.g., represented by arrow 104 of FIG. 3 and arrow 136 of FIG. 14) until the leading edge 18 of the curtain 14 is above the upper ends 60 of the primary retainer 34. At block 2506, the alignment guide 38 guides the curtain 14 (e.g., by engaging the secondary projection 36) onto the curtain-supporting structure 30 as the curtain 14 rises to realign the primary projection. In such examples, by raising the curtain above the upper ends 60 of the primary retainer 34 (block 2504) while guiding the curtain 14 onto the curtain-supporting structure 30, the primary projection 32 on the curtain 14 will clear the upper end 60 of the primary retainer 34 to be brought back into alignment behind the primary retainer 34 (e.g., within the track 16 when the curtain 14 is subsequently lowered as represented by arrows 138, 140 of FIGS. 15 and 16). At block 2508, the example drive unit controller 2302 restores the curtain 14 to the normal operating state (e.g., including operating at a normal speed), at which point the example method of FIG. 25 ends.

Figure 26:
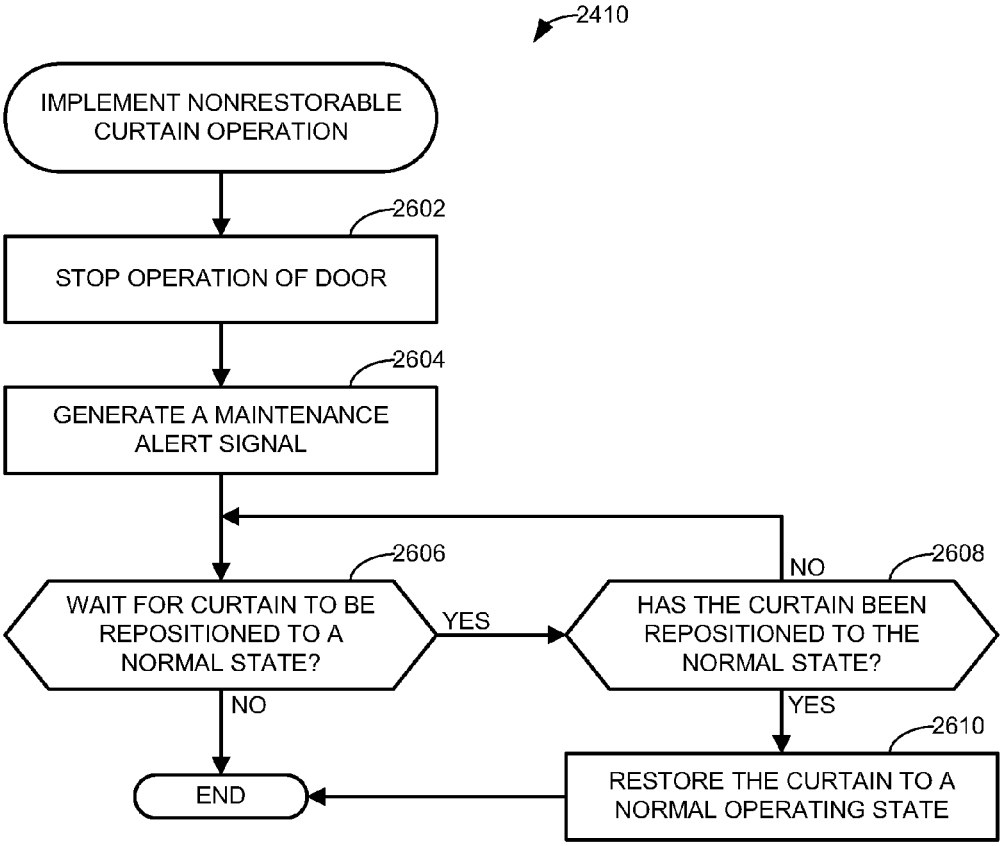
FIG. 26 is a block diagram illustrating another example method in accordance with the teachings disclosed herein.

FIG. 26 shows an example method to implement block 2410 of the example method 2400 of FIG. 24. The method blocks shown in FIG. 26 are not necessarily in any particular sequential order. In some examples, one or more of the blocks shown in FIG. 26 can be omitted, implemented simultaneously with other blocks, and/or implemented in a different order. The example method begins at block 2602 where the example drive unit controller 2302 stops the operation of the door 10 (e.g., inhibits movement of the curtain 14 as represented by the symbol 168 of FIG. 4). By stopping the curtain 14 from moving in this manner, significant damage to the curtain 14 and/or door 10 can be averted and/or mitigated. However, because of the serious nature of the curtain 14 in the breakaway state in the nonrestorable condition, the refeed operation (described above in connection with FIG. 20) may be ineffectual and a manual restoration of the curtain 14 to a normal state may be necessary. Accordingly, at block 2604 the example operator interface 2308 generates a maintenance alert signal. In this manner, maintenance personnel may be apprised of the nonrestorable condition of the breakaway state of the curtain 14 to, thereby, implement an appropriate response (e.g., manually fix or reposition the curtain 14 of the door 10 as represented by arrow 108 of FIG. 4).

At block 2606, the example drive unit controller 2302 determines whether to wait for the curtain to be repositioned to a normal state. If the example drive unit controller 2302 determines not to wait for the curtain to be repositioned, the example method of FIG. 26 ends. However, if the example drive unit controller 2302 determines to wait for the curtain to be repositioned to a normal state, control advances to block 2608 where the example operator interface 2308 determines whether the curtain 14 has been repositioned to the normal state. In some examples, the example operator interface 2308 determines when the curtain 14 has been repositioned based on feedback provided by the maintenance personnel manually fixing the door 10, which indicates that normal operations can proceed. If the example operator interface 2308 determines the curtain 14 has not been repositioned to the normal state, control returns to block 2606. If the example operator interface 2308 determines that the curtain 14 has been repositioned to the normal state, control advances to block 2610 where the example drive unit controller 2302 restores the curtain to a normal operating state, at which point the example method of FIG. 26 ends.

Figure 27:
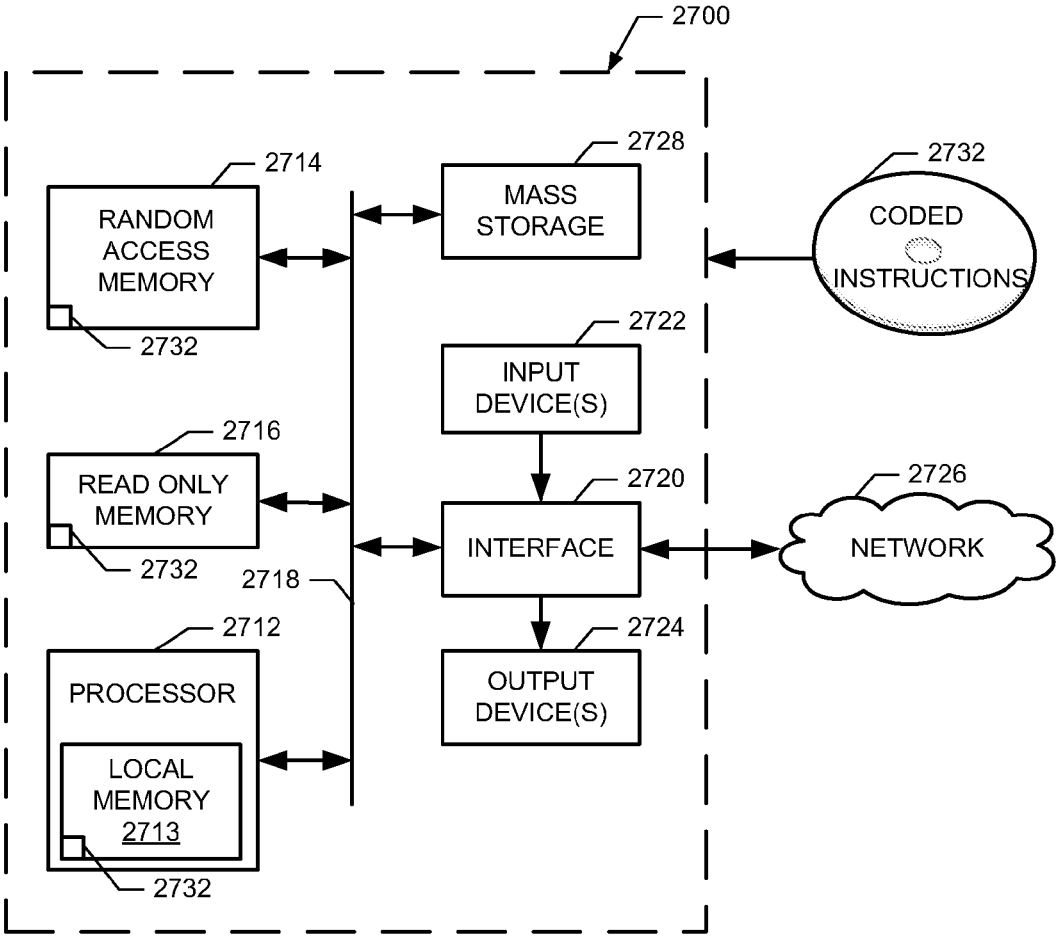
FIG. 27 is a schematic diagram of an example processor platform capable of executing the instructions of FIGS. 24-26.
Figure 28:
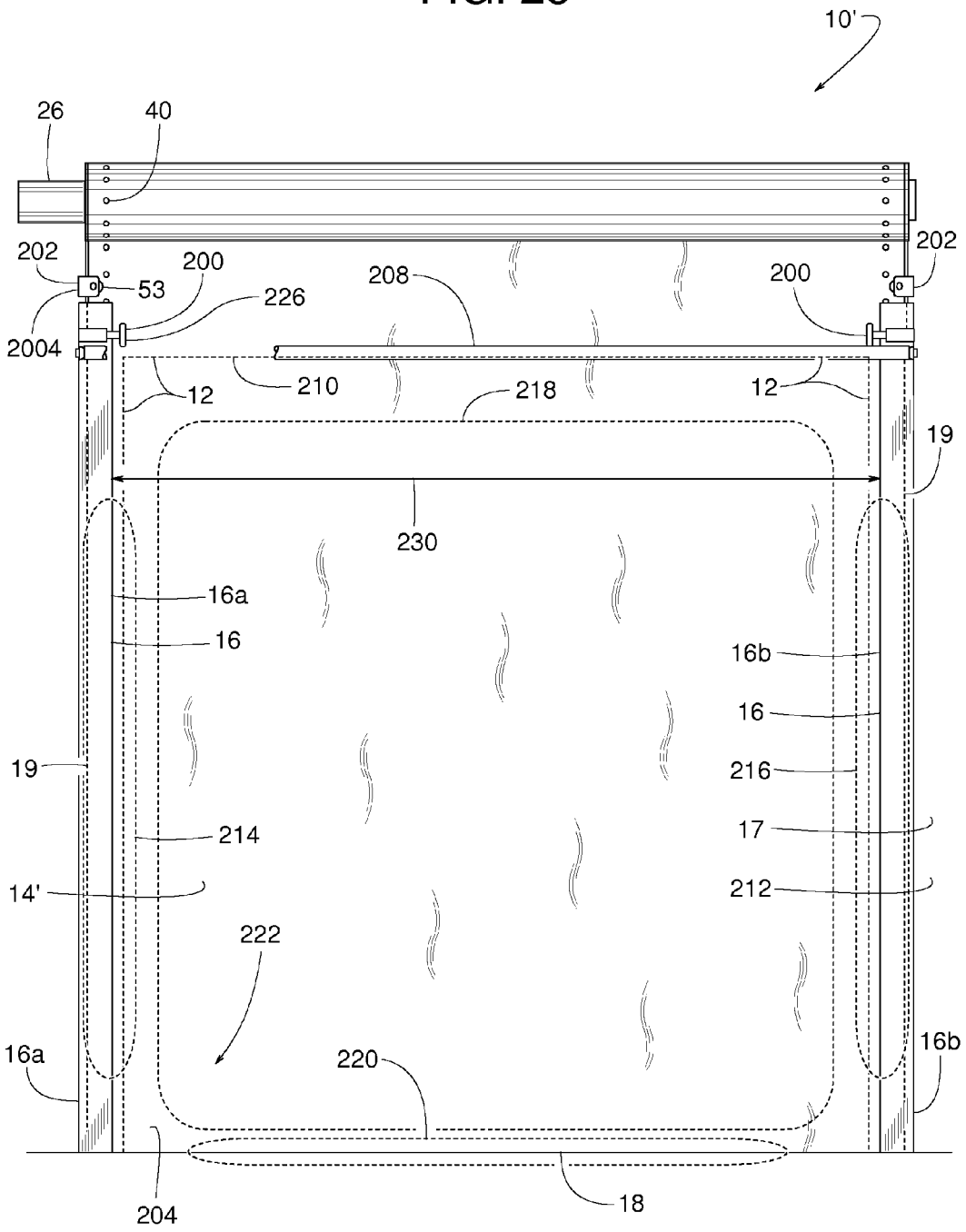
FIG. 28 a front view of another example door constructed in accordance with the teachings disclosed herein.
Figure 29:
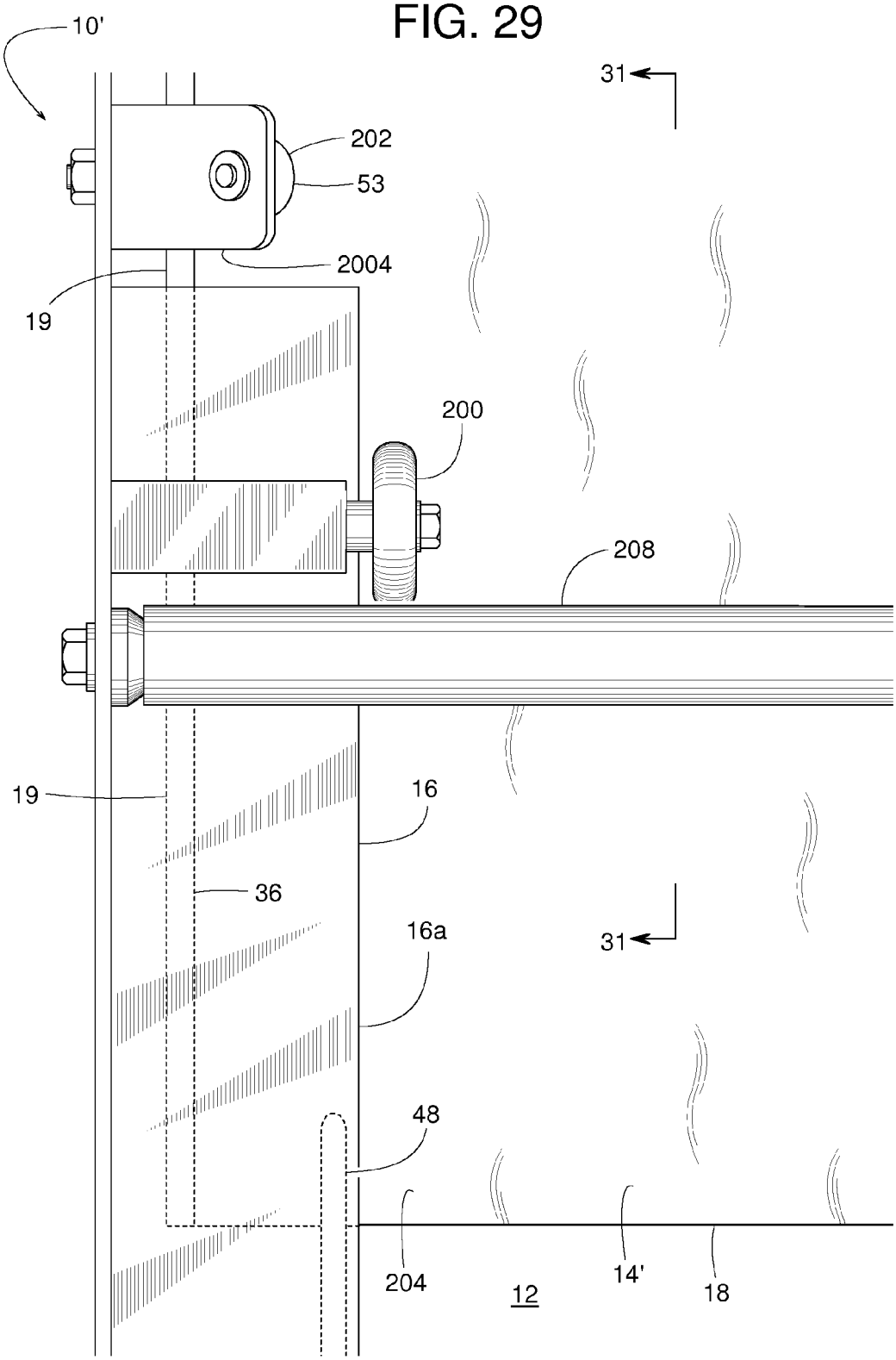
FIG. 29 is a front view of the upper left-hand area of the example door of FIG. 28.

FIG. 27 is a block diagram of an example processor platform 2700 capable of executing the instructions of FIGS. 24-26 to implement the example door 10 of FIGS. 1-4. The processor platform 2700 can be, for example, a server, a personal computer, a mobile device (e.g., a cell phone, a smart phone, a tablet such as an iPad™), or any other type of computing device.

The processor platform 2700 of the illustrated example includes a processor 2712. The processor 2712 of the illustrated example is hardware. For example, the processor 2712 can be implemented by one or more integrated circuits, logic circuits, microprocessors or controllers from any desired family or manufacturer.

The processor 2712 of the illustrated example includes a local memory 2713 (e.g., a cache). The processor 2712 of the illustrated example is in communication with a main memory including a volatile memory 2714 and a non-volatile memory 2716 via a bus 2718. The volatile memory 2714 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 2716 may be implemented by flash memory and/or any other desired type of memory device. Access to the main memory 2714, 2716 is controlled by a memory controller.

The processor platform 2700 of the illustrated example also includes an interface circuit 2720. The interface circuit 2720 may be implemented by any type of interface standard, such as an Ethernet interface, a universal serial bus (USB), and/or a PCI express interface.

In the illustrated example, one or more input devices 2722 are connected to the interface circuit 2720. The input device (s) 2722 permit(s) a user to enter data and commands into the processor 2712. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 2724 are also connected to the interface circuit 2720 of the illustrated example. The output devices 2724 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), and/or speakers). The interface circuit 2720 of the illustrated example, thus, typically includes a graphics driver card, a graphics driver chip or a graphics driver processor.

The interface circuit 2720 of the illustrated example also includes a communication device such as a transmitter, a receiver, a transceiver, a modem and/or network interface card to facilitate exchange of data with external machines (e.g., computing devices of any kind) via a network 2726 (e.g., an Ethernet connection, a digital subscriber line (DSL), a telephone line, coaxial cable, a cellular telephone system, etc.).

The processor platform 2700 of the illustrated example also includes one or more mass storage devices 2728 for storing software and/or data. Examples of such mass storage devices 2728 include floppy disk drives, hard drive disks, compact disk drives, Blu-ray disk drives, RAID systems, and digital versatile disk (DVD) drives.

The coded instructions 2732 of FIGS. 24-26 may be stored in the mass storage device 2728, in the volatile memory 2714, in the non-volatile memory 2716, and/or on a removable tangible computer readable storage medium such as a CD or DVD.

For further clarification, a restorable condition refers to a breakaway state in which the curtain 14 can be automatically restored to a normal state by operating the door 10. A nonrestorable condition refers to a breakaway state in which merely operating the door 10 is insufficient to return the curtain 14 to the normal state. A nonrestorable condition does not necessarily mean that it is impossible to restore the curtain 14 to the normal state, but rather a nonrestorable condition involves work beyond simply operating the door 10 as usual. In some examples, a person manually manipulates the curtain 14 to restore it to its normal state. Additionally or alternatively, in some examples, the door 10 is operated in a nonstandard or special manner to restore the curtain 14 to its normal state (e.g., at a slower speed and/or a slower acceleration). The terms, "blocking" and "unblocking" as used in reference to the door 10 blocking or unblocking the doorway 12 does not necessarily mean that the doorway 12 is completely obstructed or completely unobstructed but rather means that the doorway 12 is more obstructed when the door 10 is blocking doorway 12 than when the door 10 is unblocking the doorway 12. The controller 24 is schematically illustrated to represent any device that provides an output (e.g., a command or power output 116 to the drive unit 26) in response to an input (e.g., the signals 66, 122 from the sensors 64, 120). Examples of the controller 24 include, but are not limited to, a relay circuit, a computer, a programmable logic controller (PLC), and various combinations thereof. The expression, an item being "associated with a first track" and similar expressions mean that the item relates or pertains to the first track as opposed to another track and does not necessarily mean that the item is attached or coupled to the first track.

Figure 32:
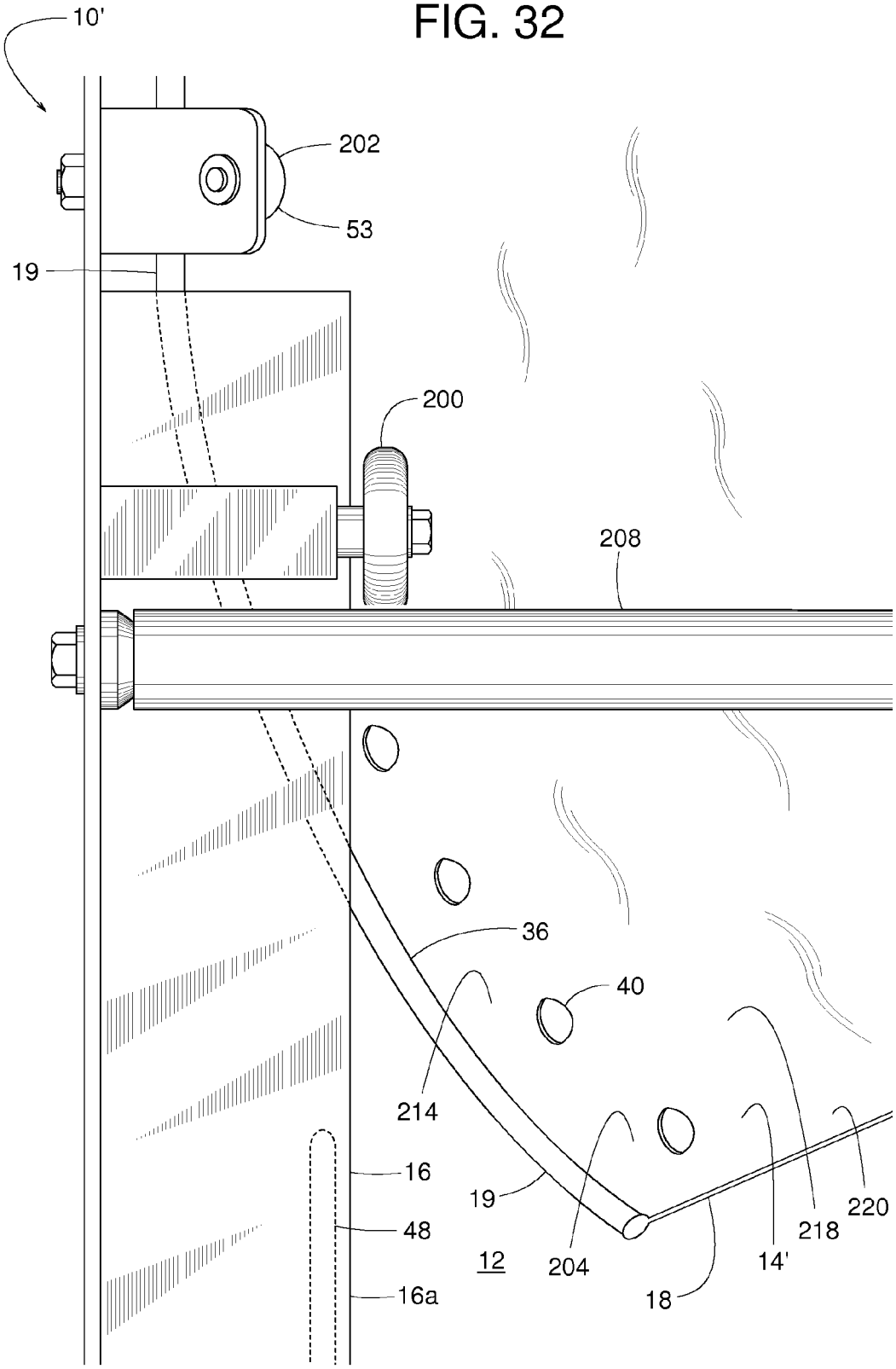
FIG. 32 is a front view similar to FIG. 29 but showing the curtain of the example door in a breakaway state in an unfolded condition.
Figure 33:
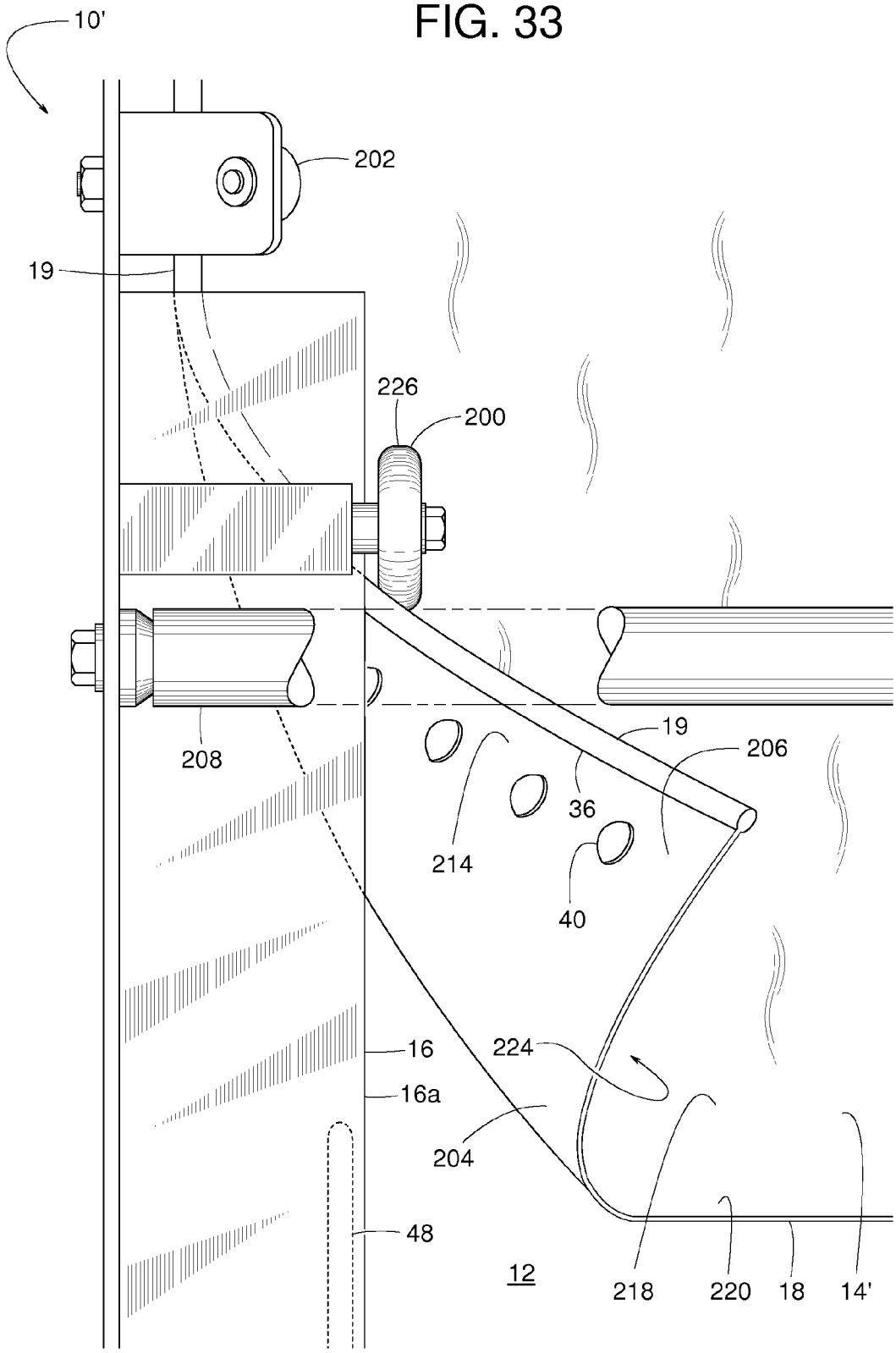
FIG. 33 is a front view similar to FIG. 29 but showing the curtain of the example door in a breakaway state in a folded-over condition.

Additionally or alternatively, some examples of the door 10 include means for restoring a dislodged, folded-over door curtain to its normal operating condition. FIGS. 28-33, for instance, show an example door 10' with example unfolders 200 installed near the upper corners of the doorway 12, just below an example refeed mechanism 202 (e.g., the bracket 2004 with the rollers 53). If a curtain 14' becomes dislodged out from within the track 16 and a portion 204 of the curtain 14' bends over to create a folded-over section 206, as shown in FIG. 33, the unfolder 200 automatically unfolds the folded-over section 206 in response to the drive unit 26 raising the curtain 14' while the refeed mechanism 202 guides the curtain 14' back into the track 16.

In addition to having the unfolder 200, some examples of the door 10' also have a front bar 208 (e.g., a rotatable or stationary (e.g., not rotatable) steel tube) set at about the same height as a lintel 210 of the doorway 12 in front of a front side 232 of the curtain 14'. As used herein, the front side 232 (FIG. 34) corresponds to a side of the curtain 14' facing away from a front face 212 of wall 217 that defines the doorway 12, whereas a back side 234 (FIG. 34) of the curtain 14' corresponds to a side of the curtain facing toward the front face 212 of the wall 217. In some examples, the front bar 208 helps restrain the door's curtain 14' if a severe forward impact (e.g., an impact on the back side 234 of the curtain 14') forces the curtain 14' farther away from the front face 212 of the wall 17. Conversely, in some examples, in the event of a severe rearward impact (e.g., an impact on the front side 232 of the curtain 14'), the wall's front face 212, above the lintel 210, limits the curtain's displacement in the rearward direction (e.g., a direction moving from a normal position of the curtain 14' toward the wall 17).

The curtain 14' is schematically illustrated to represent various curtain structures, examples of which include: the curtain 14 (with the edging 52 connected to the sheet portion 55), curtains having other types of edging, curtains where the bead 48 is an integral part of the sheet portion 55, curtains where the buttons 40 are an integral part of the sheet portion 55, curtains where the buttons 40 are attached directly to the sheet portion 55 without the edging 52, curtains where the bead 48 is attached directly to the sheet portion 55 without the edging 52, curtains without the bead 48, and curtains without the buttons 40. In the illustrated example, the curtain 14' comprises a first lateral section 214 extending into the first track 16*a*, a second lateral section 216 extending into the second track 16*b*, a main section 218 between the lateral sections 214 and 216, and a leading section 220 along the curtain's leading edge 18. The first and second lateral sections 214 and 216 each include a corresponding lateral edge 19, and the leading section 220 includes the leading edge 18 of the curtain 14'.

The curtain's leading section 220 is movable between a closed position (e.g., FIGS. 2 and 28) and an open position (e.g., FIG. 1). In the illustrated examples, the curtain 14' can be in a normal state (e.g., FIGS. 28-31) and various breakaway states (e.g., FIGS. 32 and 33). In a breakaway state, the curtain 14' can be in a folded condition (FIG. 33) or in an unfolded condition (FIG. 32), both of which are associated with a restorable condition as described above. Although FIGS. 32 and 33 show the first lateral section 214 in the unfolded and folded conditions, the same conditions (e.g., folded and unfolded) may also occur with along the second lateral section of the curtain 14'. As such, the following description related with respect to the first lateral section 214 applies equally to the second lateral section 216. In some examples, when the curtain 14' is in a breakaway state in the folded condition, the first lateral section 214 is dislodged out from within first track 16*a*, as shown in FIG. 33. Further, when the curtain 14' is in the folded condition of the illustrated example of FIG. 33, the first lateral section 214 (in an area 222 near the leading section 220) is not only dislodged out from within the first track 16*a* but is also folded over the main section 218. That is, in some examples, the front side 232 of the portion 204 of the curtain 14' is folded so as to face the front side 232 of the rest of the curtain 14'. In other examples, the curtain 14' may fold the opposite direction such that the back side 234 of the portion 204 of the curtain 14' is folded so as to face the back side 234 of the rest of the curtain 14'. In some examples, the first lateral section 216 of the folded-over section 206 (formed from the portion 204) of the curtain 14' is touching the main section 218. In other examples, the portion 204 is folded over to face the main section 218 without necessarily touching the main section 218. In some examples, the folded-over section 206 extends into the track 16 as shown in FIG. 33. As shown in the illustrated example, the folded-over section 206 creates a cavity or an enfolded space 224 between the first lateral section 214 and the main section 218. In contrast to the folded condition, when the curtain 14' is in the unfolded condition, the first lateral section 214 (in the area 222 near the leading section 220) is dislodged from the first track but not folded over onto the main section 218.

Once the curtain 14' is in a breakaway state in the folded condition, the drive unit 26 opens the door 10' to return the curtain 14' to its normal operating condition. In the illustrated example, as the door 10' continues to open, the first lateral section 214 is drawn up against the unfolder 200. As the leading edge 18 continues rising, the unfolder 200 urges the first lateral section 214 back to the unfolded condition so that the refeed mechanism 202 can direct the first lateral section 214 back into its proper position within the track 16*a*.

Figure 30:
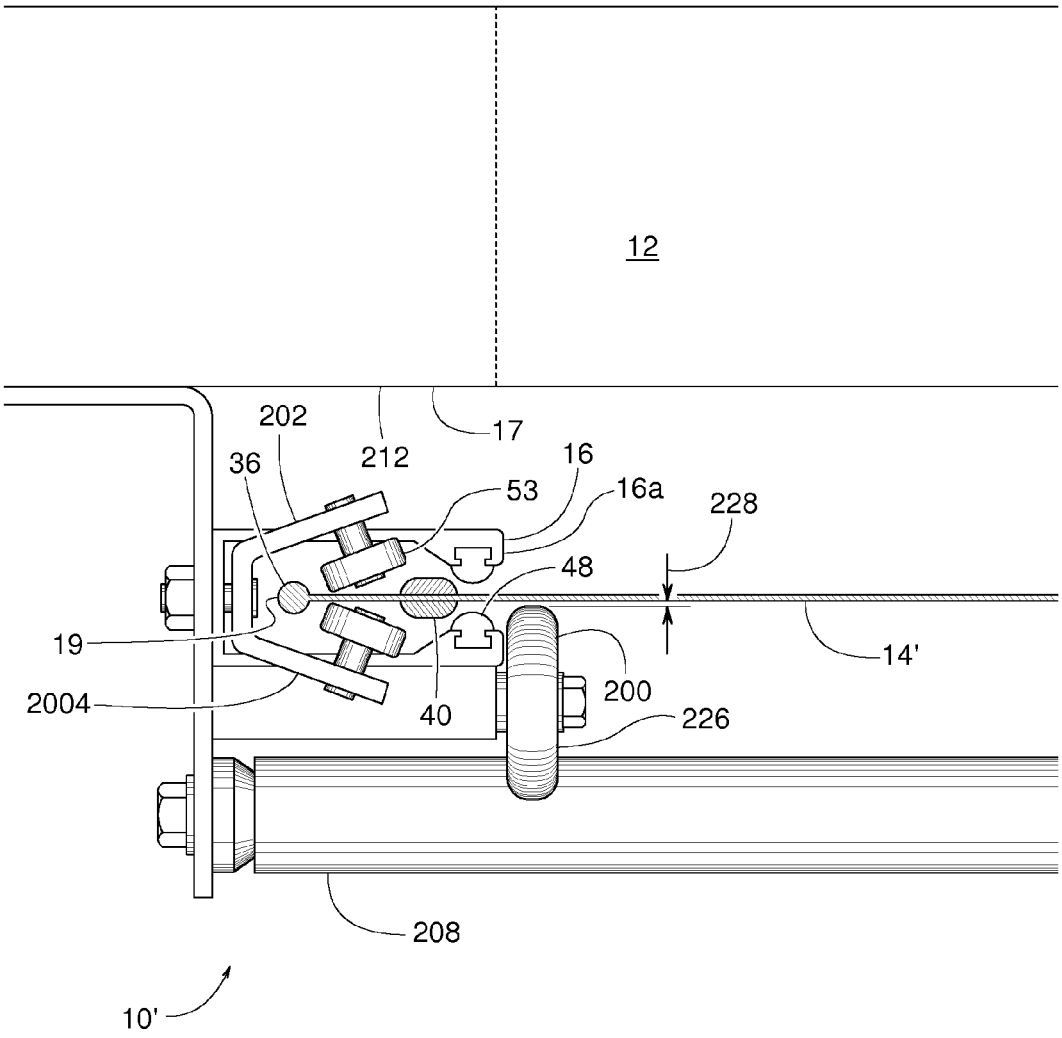
FIG. 30 is a top view of the area shown in FIG. 29.
Figure 31:
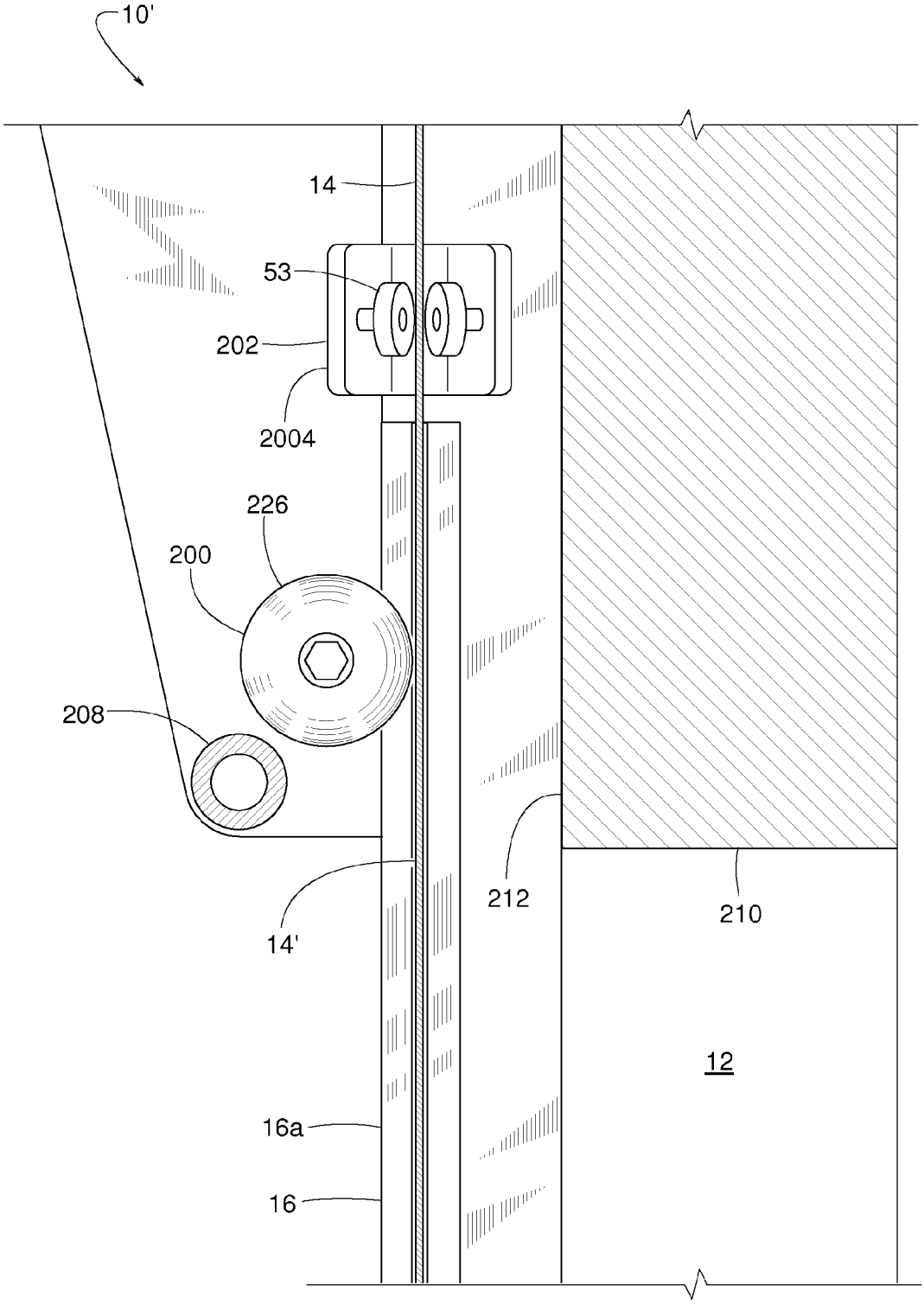
FIG. 31 is a cross-sectional view taken along line 31-31 of FIG. 29.

The unfolder's specific structure and its location relative to other components of the door 10' can vary. For instance, in some examples, the unfolder 200 is positioned to extend into and, thereby, engage the enfolded space 224 to unfold the curtain 14' more effectively. In some examples, the unfolder 200 is in the form of a roller 226 to reduce wear, particularly wear on the curtain 14'. In some examples, the unfolder 200 is positioned to be slightly spaced apart from the curtain 14' when operating under normal conditions to further reduce wear. FIG. 30, for example, shows a clearance 228 between the unfolder 200 and the curtain 14'. However, in some examples, flexibility of the curtain 14' and/or the clearance between the curtain 14' and the beads 48 might allow occasional or some contact between the unfolder 200 and the curtain 14' during normal door operation.

In some examples, the unfolder 200 is a stationary member to reach into the enfolded space 224 to more effectively unfold the folded-over section 206 and to avoid the disadvantages of moving parts. In some examples, the unfolder 200 is positioned laterally within a span 230 between the tracks 16*a*, 16*b* to more effectively catch a folded-over section 206 that is well within the span 230. In some examples where the unfolder 200 is positioned within the span 230, the unfolder 200 is higher than the doorway 12 so as not to obstruct the doorway 12. In some examples, the curtain 14' lies between the wall 17 and the unfolder 200 so that the unfolder 200 can correct forward breakaway conditions, and the wall 17 can help block rearward breakaway conditions. In some examples, the unfolder 200 is above the front bar 208 so that the front bar 208 can help prevent a severe breakaway from forcing the curtain 14' completely away from the unfolder 200.

Figure 34:
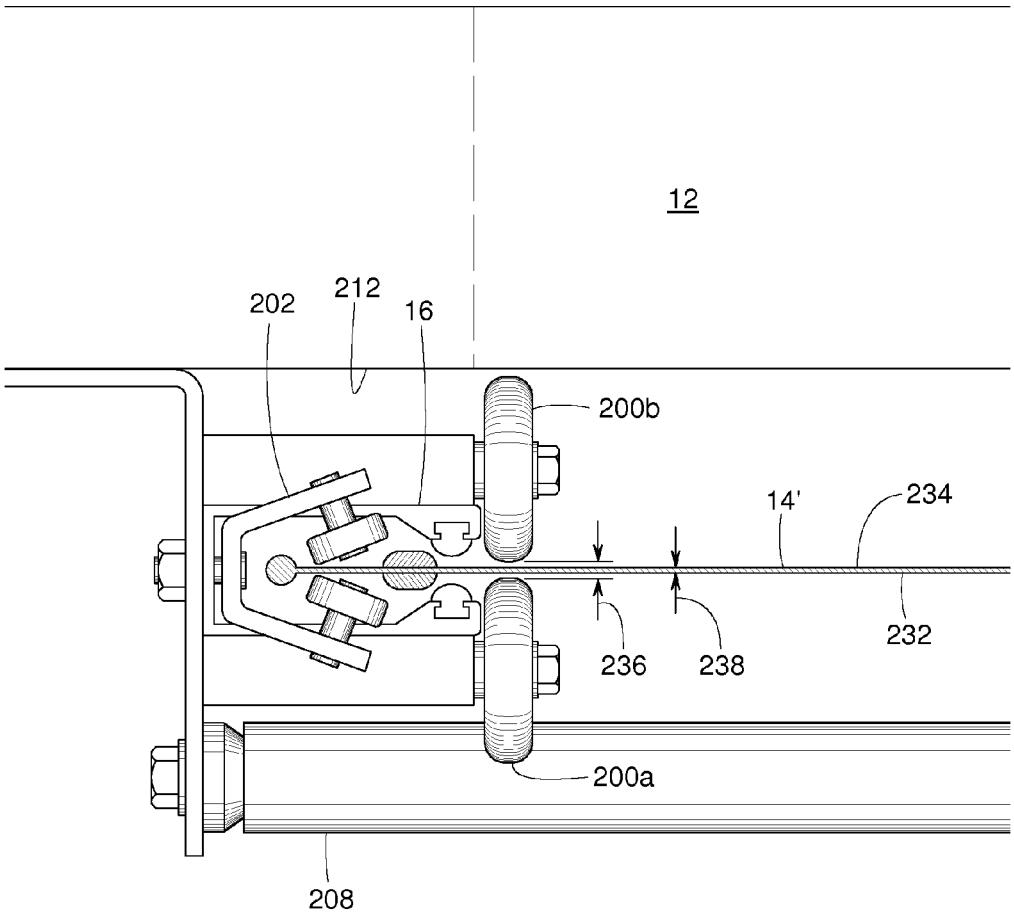
FIG. 34 is a top view similar to FIG. 30 but showing another example door constructed in accordance with the teachings disclosed herein.

Some examples of the door 10', as shown in FIG. 34, include a first unfolder 200*a* and a similar second unfolder 200*b*, which are installed at the curtain's front side 232 and back side 234, respectively. In some examples, the first unfolder 200*a* unfolds curtain 14' dislodged and folded over in a direction away from the doorway 12, as shown in FIG. 33, and the second unfolder 200*b* can unfold the curtain 14' dislodged and folded over in the opposite direction into the doorway 12. To reduce wear, in some examples, a separation distance 236 between the unfolders 200*a*, 200*b* is greater than a material thickness 238 of the curtain 14'.

Figure 35:
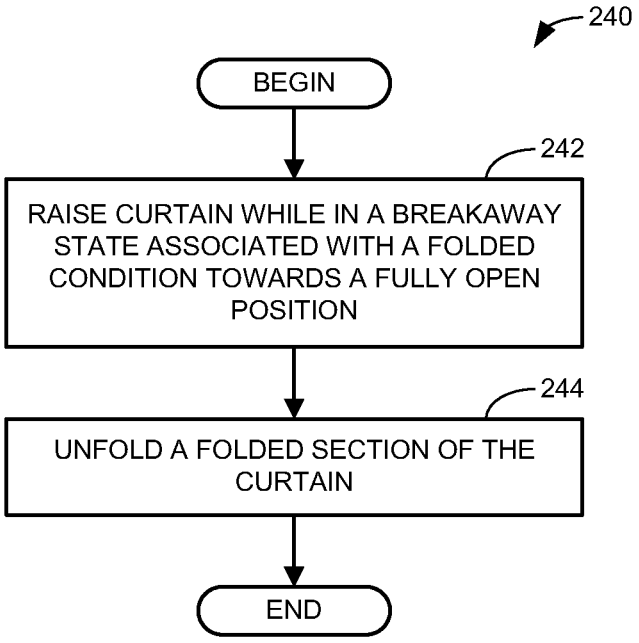
FIG. 35 is a block diagram illustrating another example door method in accordance with the teachings disclosed herein.

FIG. 35 illustrates an example door method 240 using one or more of the door examples disclosed herein. In some examples, the method of FIG. 35 is implemented as part of the refeed operation described above in connection with FIGS. 24 and 25. In other examples, the method of FIG. 35 is implemented without the corresponding refeed mechanism 202 described above. The example method of FIG. 35 begins at block 242 where the drive unit 26 raises the curtain 14' while in a breakaway state associated with a folded condition towards a fully open position. At block 244, the unfolder 200 unfolds the folded section 206 of the curtain. That is, the unfolder 200 engages the enfolded space 224 defined by the folded-over section 206 to exert a force on the folded-over section 206 as the curtain 14' is raised and forced up against the unfolder 200. In some examples, due to the force exerted by the unfolder 200, the folded-over section 206 will unfold to then enable the curtain 14' to be refed as described above. Accordingly, once the folded-over section 206 is unfolded the example method of FIG. 35 ends (e.g., to return to the rest of the example method of FIG. 24).

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. A door for selectively blocking and unblocking a doorway through a wall, the door comprising:

a first track;

a second track spaced laterally from the first track to define a span between the first track and the second track;

a curtain including a main section, a first lateral section, a second lateral section, and a leading section; the first lateral section to extend into the first track, the second lateral section to extend into the second track, the main section extending between the first lateral section and the second lateral section, the main section spaced apart from the first track and the second track, the leading section below the main section and extending between the first lateral section and the second lateral section, the leading section movable selectively to a closed position and an open position, the curtain to block the doorway when the leading section is at the closed position, the curtain to unblock the doorway when the leading section is at the open position, the curtain in a normal state when the first lateral section in an area proximate the leading section is in guiding engagement with the first track, the curtain in a breakaway state associated with a folded condition when the first lateral section in the area proximate the leading section is dislodged from the first track and folded over onto the main section to define an enfolded space between a folded over portion of the first lateral section and the main section, the curtain in the breakaway state associated with an unfolded condition when the first lateral section in the area proximate the leading section is dislodged from the first track but not folded over onto the main section; and an unfolder disposed within the span between the first track and the second track, the unfolder to extend into the enfolded space as the leading section moves toward the open position while the curtain is in the folded condition such that the unfolder extends below an edge of the curtain, the edge being along the folded over portion.

2. The door of claim 1, wherein the unfolder includes a roller.

3. The door of claim 1, wherein the unfolder is positioned spaced apart from the curtain to define a clearance between the unfolder and the curtain at least some of the time while the curtain is in the normal state.

4. The door of claim 1, wherein the unfolder is higher than the doorway.

5. The door of claim 1, wherein the curtain lies between the wall and the unfolder when the curtain is in the normal state and the leading section is in the closed position.

6. The door of claim 1, further including a second unfolder, the curtain to lie between the unfolder and the second unfolder with the wall being closer to the second unfolder than to the unfolder.

7. The door of claim 1, further including a front bar to extend across the span between the first track and the second track, the front bar spaced apart from the curtain and lower than the unfolder.

8. The door of claim 1, wherein the enfolded space extends into the first track.

9. A door for selectively blocking and unblocking a doorway through a wall, the door comprising:

a first track;

a second track spaced laterally from the first track to define a span between the first track and the second track;

a curtain including a main section, a first lateral section, a second lateral section, and a leading section; the first lateral section to extend into the first track, the second lateral section to extend into the second track, the main section extending between the first lateral section and the second lateral section, the main section spaced apart from the first track and the second track, and the leading section below the main section and extending between the first lateral section and the second lateral section, the leading section movable selectively to a closed position and an open position, the curtain to block the doorway when the leading section is at the closed position, the curtain to unblock the doorway when the leading section is at the open position, the curtain in a normal state when the first lateral section in an area proximate the leading section is in guiding engagement with the first track, the curtain in a breakaway state associated with a folded condition when the first lateral section in the area proximate the leading section is dislodged from the first track and folded over onto the main section to define an enfolded space between the first lateral section and the main section, the curtain in the breakaway state associated with an unfolded condition when the first lateral section in the area proximate the leading section is dislodged from the first track but not folded over onto the main section;

an unfolder disposed within the span between the first track and the second track, the unfolder to extend into the enfolded space as the leading section moves toward the open position while the curtain is in the folded condition;

a retainer borne by the first track;

an alignment guide associated with the first track, the alignment guide spaced apart from the retainer;

a primary projection borne by the curtain, the primary projection in guiding engagement with the retainer within the first track when the leading section is traveling between the open position and the closed position while the curtain is in the normal state, the primary projection dislodged from the first track when the curtain is in the breakaway state; and a secondary projection borne by the curtain and spaced apart from the primary projection, the secondary projection arranged to travel proximate the alignment guide when the leading section is traveling between the open position and the closed position while the curtain is in the normal state.

10. The door of claim 9, wherein the alignment guide is both vertically and horizontally offset relative to the retainer, and the alignment guide is higher than the retainer.

11. The door of claim 9, wherein the primary projection is one of a plurality of spaced apart projections distributed along a line.

12. The door of claim 9, wherein the retainer is vertically elongate, and the secondary projection is vertically elongate when the leading section is at the closed position.

13. The door of claim 9, wherein the alignment guide includes a roller.

14. A door for selectively blocking and unblocking a doorway through a wall, the door comprising:

a first track;

a second track spaced laterally from the first track to define a span between the first track and the second track;

a curtain including a leading section at a bottom of the curtain, the curtain in a normal state when a first lateral section of the curtain in an area proximate the leading section is in guiding engagement with the first track, the curtain in a breakaway state associated with a folded condition when the first lateral section in the area proximate the leading section is dislodged from the first track and folded over onto a main section of the curtain to define an enfolded space between a folded over portion of the first lateral section and the main section, the curtain in the breakaway state associated with an unfolded condition when the first lateral section in the area proximate the leading section is dislodged from the first track but not folded over onto the main section; and an unfolder in a form of a roller disposed within the span between the first track and the second track, the unfolder higher than the doorway, the curtain lying between the wall and the unfolder when the curtain is in a closed position in the normal state, the unfolder to extend into the enfolded space as the curtain moves toward an open position while in the folded condition such that the unfolder extends below an edge of the curtain, the edge being along the folded over portion.

15. The door of claim 14, wherein the unfolder is positioned spaced apart from the curtain to define a clearance between the unfolder and the curtain at least some of the time while the curtain is in the normal state.

16. A door method for use with a door at a doorway through a wall, wherein the door includes a track, a drive unit and a curtain, the door method comprising:

moving the curtain to open the door when the curtain is in a folded condition of a breakaway state, the breakaway state occurring when a portion of the curtain is dislodged from within the track, the folded condition corresponding to the portion bending over onto a main section of the curtain, thereby defining a folded over section of the curtain;

moving the folded over section up against an unfolder as the curtain is moved to open the door, the unfolder to extend into an enfolded space defined between the main section of the curtain and the folded over section such that the unfolder extends below an edge of the curtain, the edge being along the folded over section; and unfolding the folded over section in reaction to the folded over section engaging the unfolder.

17. The door method of claim 16, wherein the unfolder engages the enfolded space as the folded over section is moved up against the unfolder.

18. The door method of claim 16, wherein the unfolder includes a roller.

19. The door method of claim 16, wherein the unfolder is higher than the doorway.

20. The door method of claim 16, wherein the curtain lies between the wall and the unfolder when the door is closed.

21. The door method of claim 16, wherein the unfolder is spaced apart from the track and positioned laterally within a span between the track and a second track on an opposite side of the doorway.

* * * * *